US011043106B2

(12) United States Patent
Banczak

(10) Patent No.: US 11,043,106 B2
(45) **Date of Patent: *Jun. 22, 2021**

(54) SYSTEM AND METHOD FOR REMOTE PROPERTY MANAGEMENT

(71) Applicant: Turnkey Vacation Rentals, Inc., Austin, TX (US)

(72) Inventor: John Banczak, Austin, TX (US)

(73) Assignee: Turnkey Vacation Rentals, Inc., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/600,190

(22) Filed: Oct. 11, 2019

(65) Prior Publication Data

US 2020/0058212 A1 Feb. 20, 2020

Related U.S. Application Data

(63) Continuation of application No. 15/994,557, filed on May 31, 2018, now Pat. No. 10,482,754.
(Continued)

(51) Int. Cl.
*G08B 25/00* (2006.01)
*G08B 13/08* (2006.01)
(Continued)

(52) U.S. Cl.
CPC ..... *G08B 25/001* (2013.01); *E05B 45/06* (2013.01); *G08B 13/08* (2013.01);
(Continued)

(58) Field of Classification Search
CPC .... G08B 13/00; G08B 13/08; G08B 13/1654; G08B 13/1672; G08B 25/001; G08B 25/008; G08B 21/00; G08B 21/18; G08B 21/187; G08B 21/182; G08B 13/19682; E05B 45/06; E05B 2045/0695; G05B 19/048; G06Q 10/0631
See application file for complete search history.

(56) References Cited

U.S. PATENT DOCUMENTS 6,603,401 B1 * 8/2003 Ueyama ..... A61B 5/0002 340/286.07
7,113,090 B1 * 9/2006 Saylor ..... G08B 13/19682 340/5.33

(Continued)

*Primary Examiner* — Andrew W Bee
(74) *Attorney, Agent, or Firm* — Michael Best & Friedrich LLP

(57) ABSTRACT

A system for use in a residential property, the system including a first computing system positionable in the residential property and including a first memory and a first processor. The system also includes a second computing system including a second memory and a second processor, the second computing system in communication with the first computing system over a network. The first memory comprises program instructions executable by the processor of the first computing system to: recognize a sound indicative of an unexpected event; retrieve, from a database stored in the first memory, an acoustic profile of the unexpected event; and responsive to the identifying the unexpected event, transmit a notification including an identity of the acoustic profile of the unexpected event to the second computing system over the network.

14 Claims, 22 Drawing Sheets

Related U.S. Application Data

(60) Provisional application No. 62/513,337, filed on May 31, 2017.

(51) Int. Cl.
*G08B 21/18* (2006.01)
*E05B 45/06* (2006.01)
*G08B 13/196* (2006.01)

(52) U.S. Cl.
CPC ..... *G08B 13/19682* (2013.01); *G08B 21/182* (2013.01); *G08B 25/008* (2013.01); *E05B 2045/0695* (2013.01)

(56) References Cited

U.S. PATENT DOCUMENTS 8,768,294 B2 * 7/2014 Reitnour ..... H04W 4/90 455/404.2
10,229,394 B1 * 3/2019 Davis ..... H04L 41/0654
10,573,106 B1 * 2/2020 Brady ..... G06Q 10/083
2003/0069002 A1 * 4/2003 Hunter ..... G09F 27/00 455/404.2
2006/0104312 A1 * 5/2006 Friar ..... G08B 1/08 370/506
2006/0155851 A1 * 7/2006 Ma ..... H04L 12/2836 709/226
2007/0090920 A1 * 4/2007 Canter ..... G07C 9/27 340/5.65
2011/0102133 A1 * 5/2011 Shaffer ..... G08B 25/14 340/5.1
2011/0313555 A1 * 12/2011 Shoham ..... G08B 21/0208 700/94
2015/0364028 A1 * 12/2015 Child ..... G08B 1/08 348/143
2016/0343239 A1 * 11/2016 Lamb ..... G08B 25/009
2016/0379456 A1 * 12/2016 Nongpiur ..... G08B 13/1672 340/541
2017/0011318 A1 * 1/2017 Vigano ..... G06Q 50/08
2017/0064412 A1 * 3/2017 Taxier ..... H04N 21/4882
2017/0109983 A1 * 4/2017 Flint ..... H04M 1/0291
2017/0162216 A1 * 6/2017 Margoles ..... G08B 13/1672
2018/0286279 A1 * 10/2018 Alcaide Dias ..... G08B 1/08
2018/0330589 A1 * 11/2018 Horling ..... G08B 13/1672

* cited by examiner

SYSTEM AND METHOD FOR REMOTE PROPERTY MANAGEMENT

BACKGROUND

The present disclosure relates to remote management of residential properties, such as short-term rental properties.

Management of residential properties, such as properties available for short-term rental or short-term occupancy, is often complicated and requires the coordination of multiple tasks, such as controlling access to the property, cleaning the property, conducting property maintenance, and managing reservations. It is often time-consuming to organize access to the property for renters, cleaners, and maintenance workers, convey one-time instructions to cleaners and maintenance workers, and to respond to unexpected events that occur when the property is occupied by a renter or when the property is unoccupied.

SUMMARY

In one embodiment, the disclosure provides a system for use in a residential property, the system including a first computing system positionable in the residential property and including a first memory and a first processor. The system also includes a second computing system including a second memory and a second processor, the second computing system in communication with the first computing system over a network. The first memory comprises program instructions executable by the processor of the first computing system to: recognize a sound indicative of an unexpected event; retrieve, from a database stored in the first memory, an an acoustic profile of the unexpected event; and responsive to the retrieving the type of the unexpected event, transmit a notification including an identity of the acoustic profile of the unexpected event to the second computing system over the network.

In another embodiment, the disclosure provides a computer-implemented method including the step of sensing an unexpected event in a residential property. The unexpected event is one of a sound, a temperature, and a motion. Responsive to sensing the unexpected event, the computer-implemented method further includes querying a database stored on a server to retrieve a type of the unexpected event. Responsive to the unexpected event corresponding to a trigger event, the computer-implemented method further includes retrieving a passcode for a lock controlling access to the residential property. The computer-implemented method further includes transmitting a notification of the trigger event and the passcode to a computing device operable by a user, the access code unique to the trigger event.

In another embodiment, the disclosure provides a computer-implemented method including sensing an unexpected event in a residential property. The unexpected event is one of a sound, a temperature, and a motion. Responsive to sensing the unexpected event, the computer-implemented method further includes querying a database stored on a server to retrieve a type of the unexpected event. The computer-implemented method further includes transmitting a notification of the unexpected event and the type of the unexpected event to a user. The computer-implemented method further includes prompting the user to transmit a confirmation of a response to the unexpected event to a second user.

Other aspects of the disclosure will become apparent by consideration of the detailed description and accompanying drawings.

DETAILED DESCRIPTION

Figure 1:
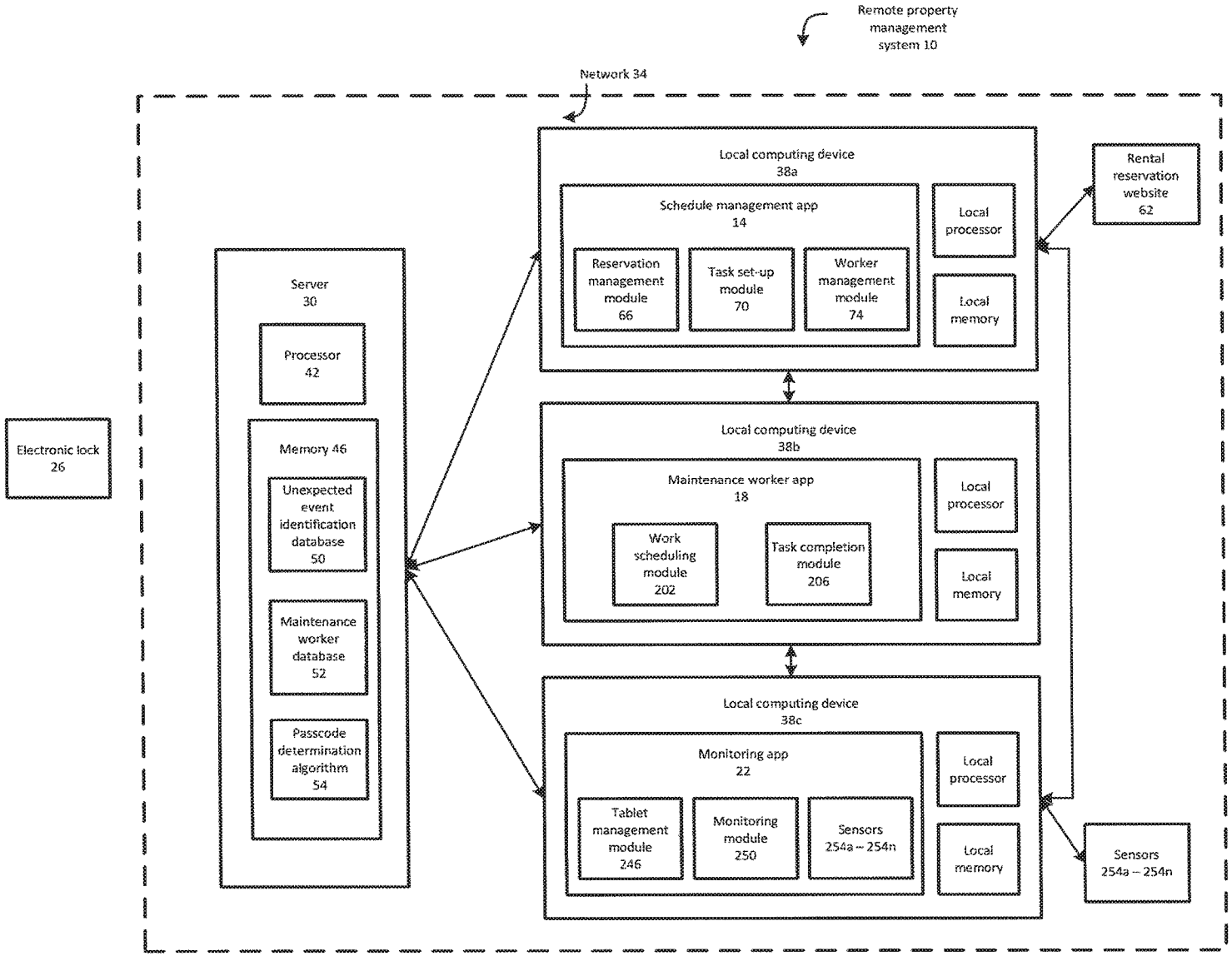
FIG. 1 illustrates a remote property management system according to some embodiments.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. The use of "including", "comprising", or "having" and variations thereof herein is meant to encompass the items listed thereafter and equivalents thereof as well as additional items. As used herein, the word "may" is used in a permissive sense (e.g. meaning having the potential to) rather than the mandatory sense (e.g. meaning must). The use of the terms "substantially", "approximately", and "about" may be substituted with "within a percentage of" what is specified, where the percentage includes 0.1, 1, 5, and 10 percent.

Some portions of the detailed description which follow are presented in terms of algorithms or symbolic representations of operations on binary digital signals stored within a memory of a specific apparatus or special purpose computing device or platform. In the context of this particular specification, the term specific apparatus or the like includes a general purpose computer once it is programmed to perform particular functions pursuant to instructions from program software. Algorithmic descriptions or symbolic representations are examples of techniques used by those of ordinary skill in the signal processing or related arts to convey the substance of their work to others skilled in the art. An algorithm is here, and is generally, considered to be a self-consistent sequence of operations or similar signal processing leading to a desired result. In this context, operations or processing involve physical manipulation of physical quantities. Typically, although not necessarily, such quantities may take the form of electrical or magnetic signals capable of being stored, transferred, combined, compared, or otherwise manipulated. It has been proven convenient at times, principally for reasons of common usage, to refer to signals as bits, data, values, elements, symbols, characters, terms, numbers, numerals, or the like. It should be understood, however, that all of these or similar terms are to be associated with appropriate physical quantities and are merely convenient labels. Unless specifically stated otherwise, the terms "processing", "computing", "calculating", "determining" or the like refer to actions or processes of a specific apparatus, such as a special purpose computer or a similar special purpose electronic computing device. In the context of this specification, therefore, a special purpose computer or similar special purpose electronic computing device is capable of manipulating or transforming signals, typically represented as physical electronic or magnetic quantities within memories, registries, or other information storage devices, transmission devices, or display devices of the special purpose computer or similar special purpose electronic computing device. The use of the variable "n" is intended to indicate that a variable number of local computing devices may be in communication with the network. The term "app" is generally used to refer to a software program stored on a memory that includes instructions executable by a processor. The term "monitor" is generally used to refer to observing a status over a period of time and detecting a status change.

FIG. 1 illustrates a schematic representation of a remote property management system 10. The remote property management system 10 includes a schedule management app 14, a maintenance worker app 18, a monitoring app 22, an electronic lock 26 that controls access to the residential property, and a server 30. The schedule management app 14, the maintenance worker app 18, and the monitoring app 22 are in communication over a network 34. The schedule management app 14, the maintenance worker app 18, and the monitoring app 22 are run on local computing devices 38*a*-38*n*. By way of non-limiting example, in the illustrated embodiment, the schedule management app 14 is run on the local computing device 38*a*, the maintenance worker app 18 is run on the local computing device 38*b*, and the monitoring app 22 is run on the local computing device 38*c*. The term "local computing device" is generally used to refer to a computing device used directly by a user such as a desktop computer, a laptop computer, a smart phone, a game console, a tablet computer, or any other device capable of communicating over the network 34. Each of the local computing devices 38*a*-38*n* includes a local processor and a local memory. The electronic lock 26 is isolated from the network 34. The server 30 manages communication between the schedule management app 14, the maintenance worker app 18, and the monitoring app 22. The server 30 includes at least one processor 42 and at least one memory 46. The memory 46 includes an unexpected event identification database 50, a maintenance worker database 52, and a passcode determination algorithm 54 adapted to return a passcode 58*a*-58*n* of the electronic lock 26.

The schedule management app 14 is typically used by a property owner or a property manager. As shown in FIG. 1, the schedule management app 14 may be in communication with at least one property rental reservation website 62 such as Airbnb, HomeAway, or VRBO over the network 34. In some embodiments, the schedule management app 14 may be operable to send data indicative of a reservation or a cancellation (e.g. manually entered or entered one of the plurality of property rental websites 58) to the property rental websites 62 over the network 34.

Figures 2A, 2B, 2C:
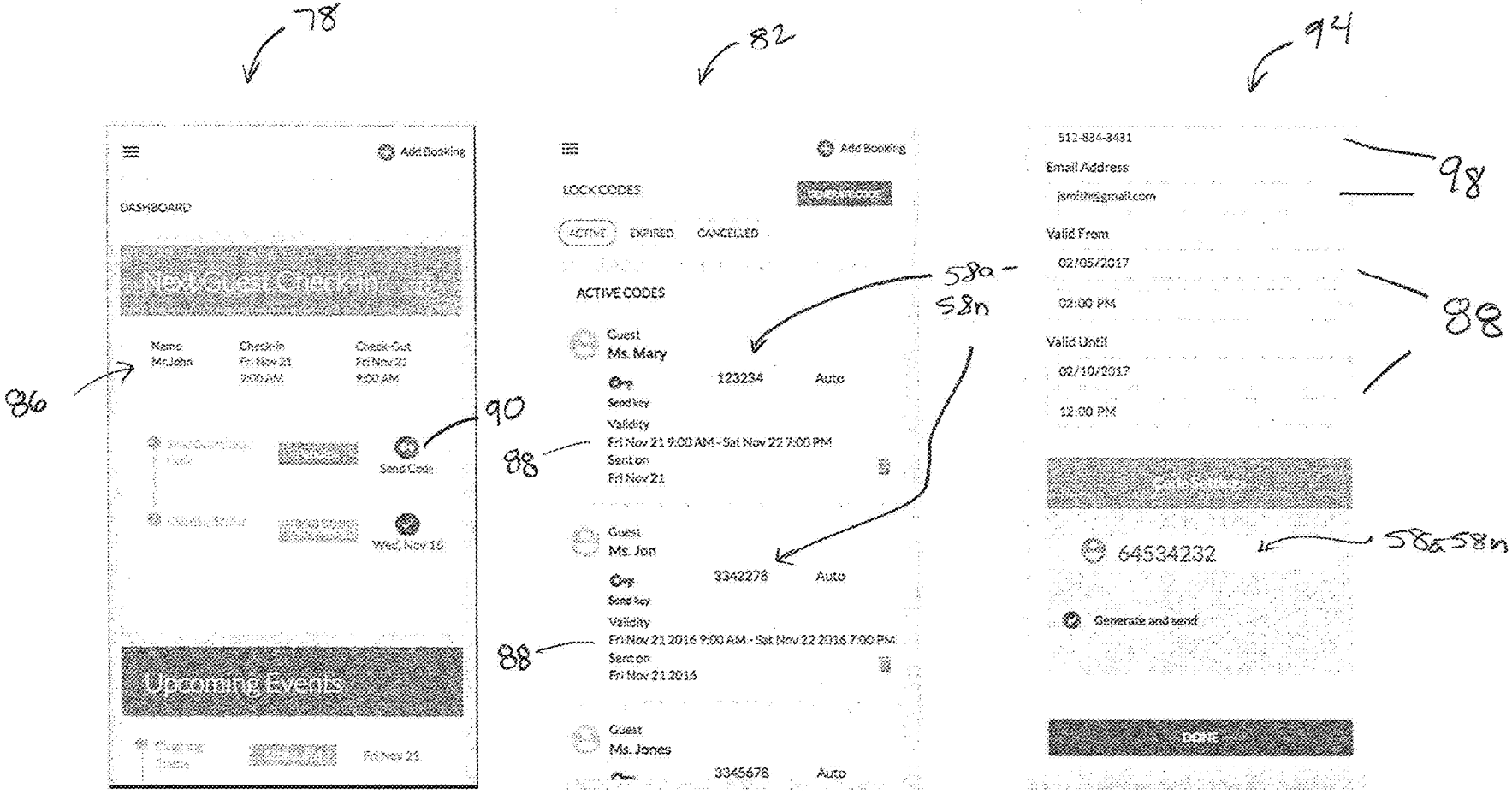
FIGS. 2A-2C illustrate interfaces of a reservation management module of a schedule management app of the remote property management system of FIG. 1 according to some embodiments.

The schedule management app 14 may include a reservation management module 66, a task setup module 70, and a worker management module 74. The reservation management module 66 includes a renter management interface 78 and a passcode management interface 82. As shown in FIG. 2A, the renter management interface 78 displays property rental requests and a list 86 of scheduled renters. The renter management interface 78 may include user inputs 90 selectable by the property owner to approve or deny pending property rental requests, send passcodes 58*a*-58*n* to approved renters, and schedule pre-rental maintenance tasks, such as cleaning.

FIG. 2B shows the passcode management interface 82. The passcode management interface 82 is operable to generate the passcode 58*a*-58*n* for new rental reservations and displays the passcodes 58*a*-58*n* for upcoming reservations. For example, in the embodiment shown in FIG. 2B, the passcode management interface 82 displays the passcodes 58*a*-58*n* by reservation and displays a passcode validity time period 88. The term "passcode validity time period" is used generally to refer to a period of time (e.g. date and time of day) for which a passcode 58*a*-58*n* is valid. Multiple passcodes 58*a*-58*n* having different passcode validity time periods 140 may co-exist simultaneously. The passcode validity time period 88 may be minutes, days, weeks, months, or years. The property owner may also use the passcode management interface 82 to cancel selected passcodes 58*a*-58*n* for property reservations. In other embodiments, the reservation requests are automatically accepted and passcodes 58*a*-58*n* are automatically sent to the renter if the residential property is available to rent. A residential property rental reservation may also be manually entered and/or manually cancelled using the schedule management app 14 using a manual reservation interface 94. As shown in FIG. 2C, the manual reservation interface 94 includes input fields 98 operable to receive rental reservation information. Exemplary reservation information may include a name of the renter, a time period for the rental reservation, an email address of the renter, or a phone number of the renter. The schedule management app 14 may communicate with the rental reservation websites 62 over the network 34 to update an availability of the residential property listed on the rental reservation websites 62 in response to manually-entered reservations or manually-entered cancellations.

Figure 3B:
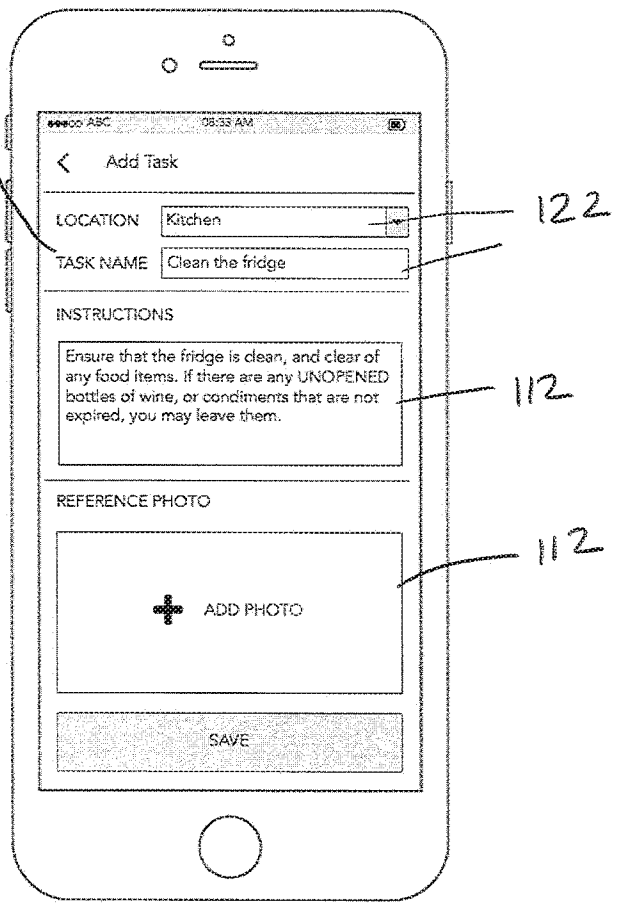
FIGS. 3A-3B illustrate screens of a task setup module of the schedule management app of the remote property management system of FIG. 1 according to some embodiments.
Figure 3A:
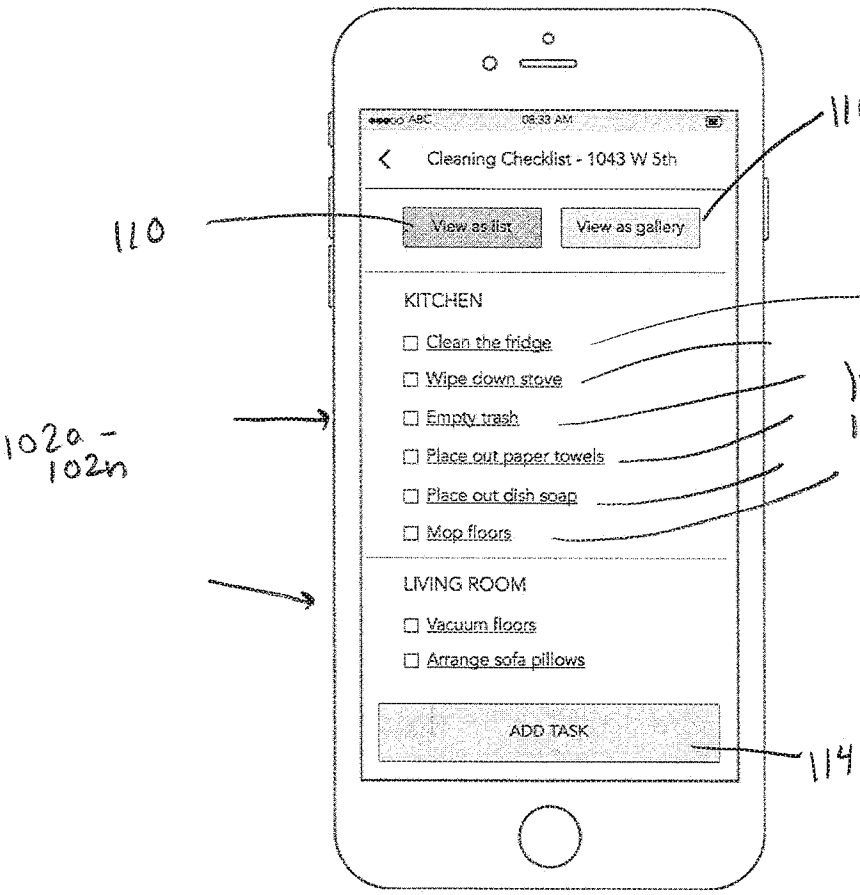

As shown in FIGS. 3A and 3B, the property owner may use the task setup module 70 to establish task lists 102*a*-102*n* for the maintenance worker to complete. The term "maintenance worker" is generally used to refer to a person who performs tasks assigned by the property owner at the residential property. For example, a maintenance worker may be a cleaner, a yard maintenance worker, a plumber, an electrician, or a contractor. The task lists 102*a*-102*n* may be for tasks such as cleaning the residential property before a reservation or cleaning the residential property after a reservation, seasonal outdoor maintenance activities, or responses to unexpected events. FIG. 3A illustrates an exemplary task display interface 106. The property owner may form the task lists 102*a*-102*n* as a written list. The property owner may also form the task lists 102*a*-102*n* by taking pictures or creating schematic representations of rooms of the residential property and may annotate the pictures or schematic representations with task completion instructions. As is shown in FIG. 3A, the property owner select whether to view the task lists 102*a*-102*n* as a written list or as a gallery of pictures or schematic representations using user inputs 110. The term "user input" is generally used to refer to an interface through which a user (e.g. a property owner, a maintenance worker, or an immediate response worker) may add information to the remote property management system 10. Exemplary user inputs may include buttons, checkboxes, drop-down menus, text input fields, or voice inputs. The task display interface 106 also includes a user input 114 that the property owner may use to enter a task modification interface 118.

FIG. 3B illustrates the task modification interface 118. The property owner may use the task modification interface 118 to generate a new task list 102*a*-102*n*, add new tasks 104*a*-104*n* to an existing task list 102*a*-102*n*, or modify existing tasks 104*a*-104*n* on an existing task list 102*a*-102*n*. As shown in FIG. 3B, the task modification interface 118 includes user inputs 122 for receiving task information input by the user. In the embodiment illustrated in FIG. 3B, the property owner may enter a location of the task 104*a*-104*n*, a name of the task 104*a*-104*n*, instructions for the task 104*a*-104*n*, or a reference image of the task 104*a*-104*n* using the task modification interface 118. The task lists 102*a*-102*n* may be stored in at least one of the memory 46 of the server 30 or the memory of the local computing devices 38*a*-38*n* running the schedule management app 14, the maintenance worker app 18, or the monitoring app 22. The property owner may require the maintenance worker to upload verification images for the tasks 104*a*-104*n* of a first task list 102*a* before the maintenance worker is permitted to begin performing the tasks 104*a*-104*n* of a second task list 102*b*-102*n*. The property owner or a third party may review the verification images to ensure that the tasks 104*a*-104*n* on the task lists 102*a*-102*n* have been completed as instructed.

Figure 4:
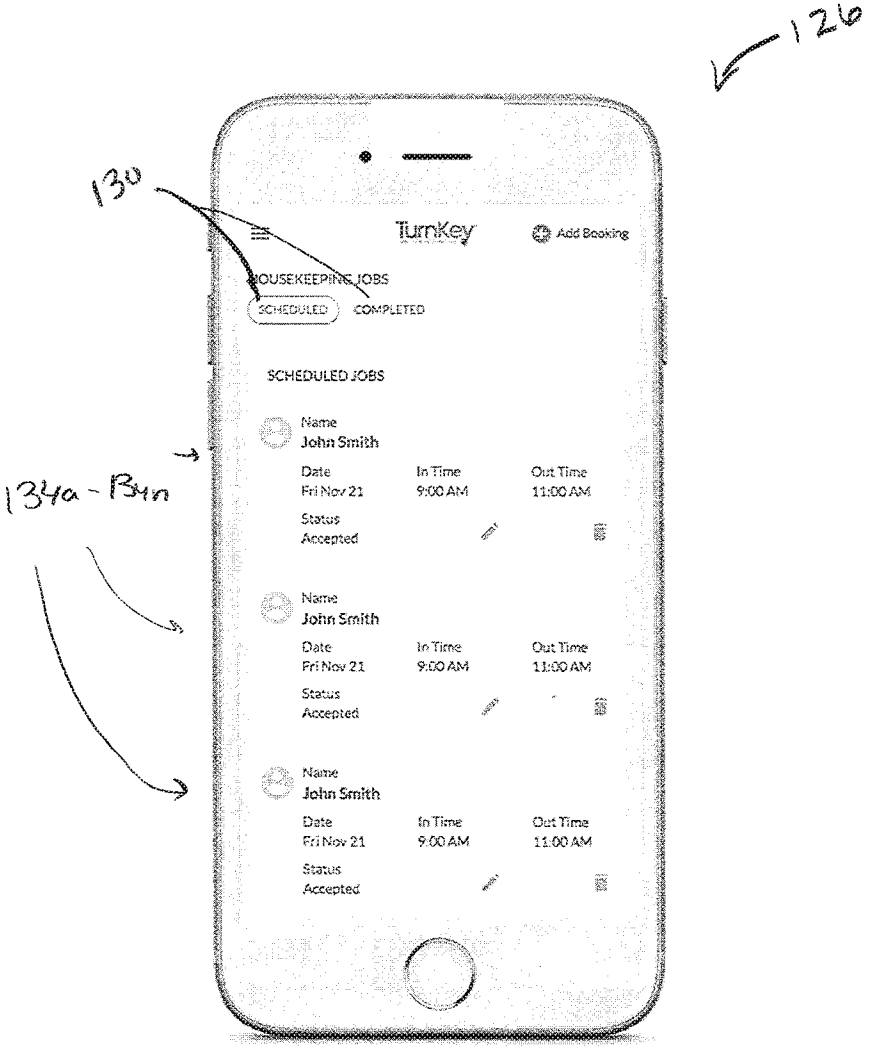
FIG. 4 illustrates a screen of a worker management module of the schedule management app of the remote property management system of FIG. 1 according to some embodiments.

FIG. 4 illustrates a worker management interface 126 of the worker management module 74. The property owner may use the worker management module 74 to manage the maintenance workers that work at the residential property. The worker management interface 126 may include a list of the times and dates the maintenance worker is scheduled to work at a residential property. The worker management interface 126 is sortable based on a status 130 of a maintenance job 134. For example, as shown in FIG. 4, the maintenance jobs 134*a*-134*n* may be sorted by whether the maintenance jobs 134*a*-134*n* are scheduled or completed. In alternate embodiments, the maintenance workers may be displayed by the residential property at which the maintenance worker is scheduled to work or the maintenance workers may be displayed by a worker type. The term "worker type" is typically used to refer to the work done by the maintenance worker. Exemplary worker types may include cleaning, yard maintenance, plumbing, electrician, repair, or immediate response. The property owner may use the schedule management app 14 to manually schedule maintenance workers, or the remote property management system 10 may automatically schedule the maintenance workers in response to receiving a rental reservation. In some embodiments, the property owner may rank the maintenance workers and the remote property management system 10 may schedule the maintenance workers according to the rank.

Figure 5:
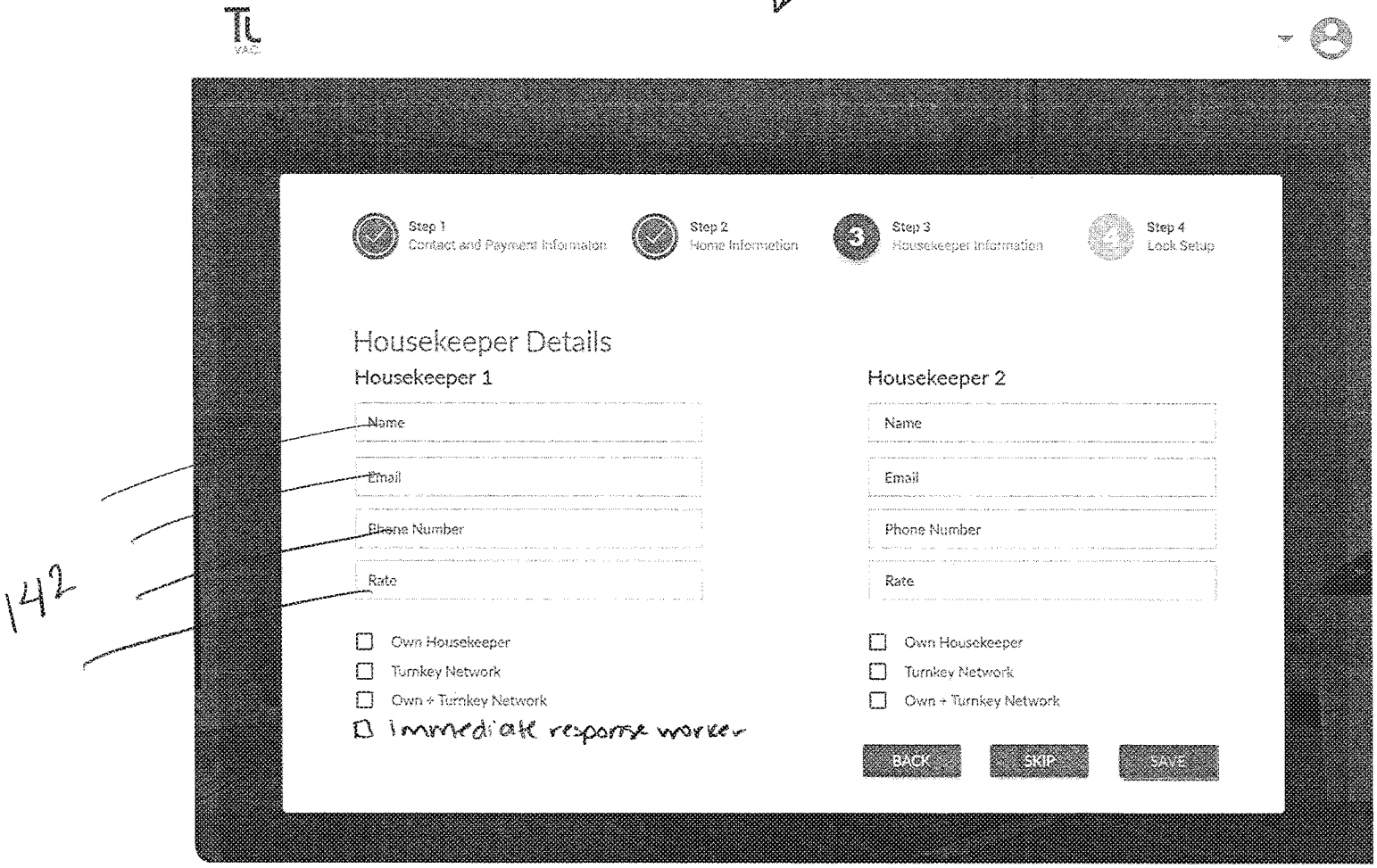
FIG. 5 illustrates a new worker entry screen the worker management module of the schedule management app of the remote property management system of FIG. 1 according to some embodiments.

FIG. 5 shows a worker entry interface 138 of the worker management module 74. As shown in FIG. 5, the property owner can use the schedule management app 14 to manually add new maintenance workers to the maintenance worker database 52 stored on the memory 46 of the server 30 or the memory of the local computing device 38*a* running the schedule management app 14. The worker entry interface 138 includes user inputs 142 into which the property owner may enter information for each of the maintenance workers. Exemplary information entered for each of the maintenance workers may include a name, an email address, a phone number, a billing rate, or the worker type. The property owner may categorize maintenance workers by worker type or by a specific residential property or a specific group of residential properties at which the maintenance worker works. The property owner may use the worker entry interface 138 to designate some maintenance workers as immediate response workers. Immediate response workers may be assigned tasks that require an immediate response by the property owner using the remote schedule management app 14 or by the remote property management system 10.

Figure 22:
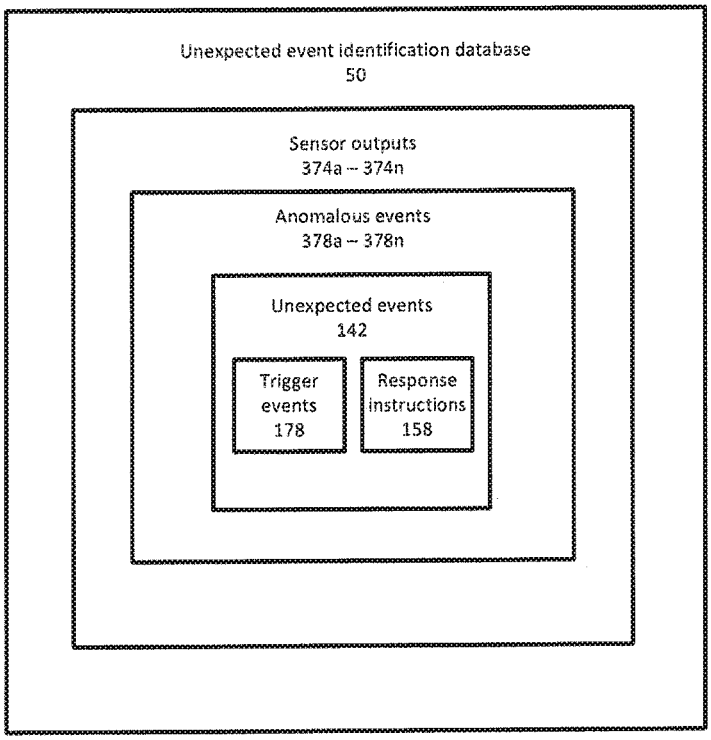
FIG. 22 illustrates a schematic representation of an unexpected event database of the remote property management system of FIG. 1 according to some embodiments.

The property owner may access the unexpected event identification database 50 stored on the memory 46 of the server 30 to designate unexpected events 146 (FIG. 22)

identifiable by the monitoring app 22 as is described in more detail below. FIG. 6A illustrates an unexpected event management interface 150. The unexpected event management interface 150 displays the unexpected events 146 designated by the property owner. As shown in FIG. 6A, the unexpected event management interface 150 displays an unexpected event type 154 and a response instruction 158. The response instruction 158 is performed by the monitoring app 22 after the monitoring app 22 has identified the unidentified event 146. The term "unexpected event type" is generally used to refer to a sensor output indicative of the unexpected event 146. Exemplary unexpected event types 154 may include audio, temperature, motion, and light. For example, in FIG. 6A, the monitoring app 22 is configured to send a trigger notification 162 (FIGS. 7A-7B and 19) to the property owner and/or a maintenance worker in response to an unexpected event 146 designated as a trigger event 178. In other constructions, the monitoring app 22 is configured to store a record of the unexpected event 146 in the memory of the local computing device 38*c* running the monitoring app 22. The unexpected event management interface 150 also includes user inputs 166 actuable by the property owner to edit existing unexpected events 146 stored in the unexpected event identification database 50 or to add new unexpected events 146 to the unexpected event identification database 50.

Figure 6B:
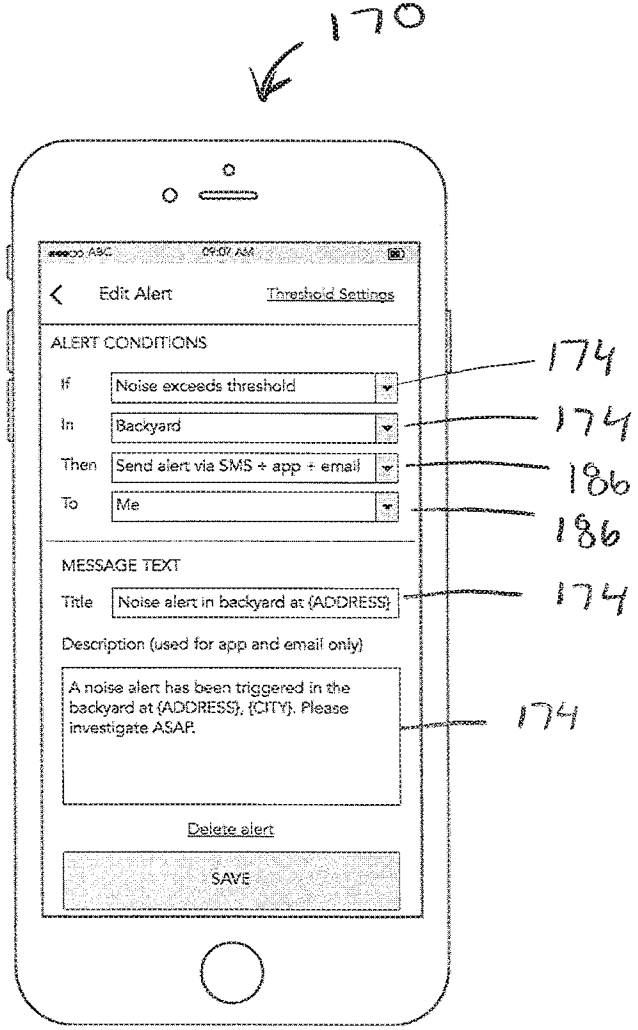
FIGS. 6A-6B illustrate unexpected event management screens of the schedule management app of the remote property management system of FIG. 1 according to some embodiments.
Figure 6A:
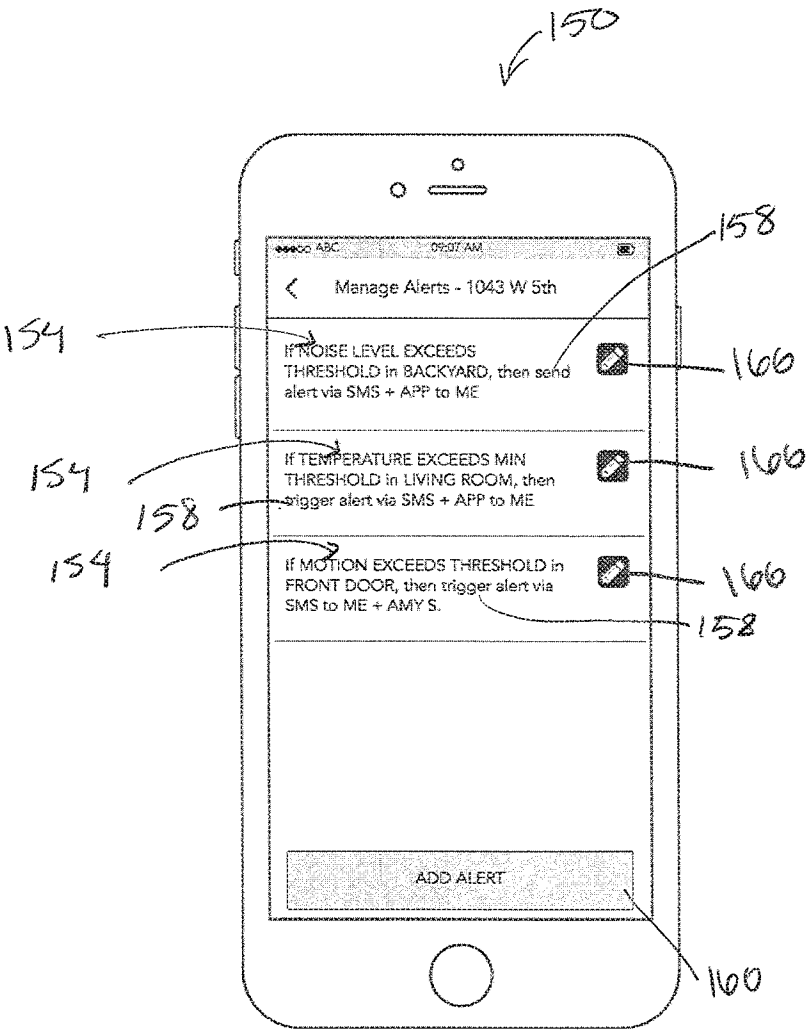

FIG. 6B illustrates an unexpected event modification interface 170 operable by the property owner to add new unexpected events 146 to the unexpected event identification database 50, to modify existing unexpected events 146, or to remove existing unexpected events from the unexpected event identification database 50. The unexpected event modification interface 170 includes user inputs 174 for receiving information about the specified unexpected event 146. As shown in FIG. 6B, the property owner may specify a sensitivity threshold at which an unexpected event 146 is identified, a location to monitor for the unexpected event 146, and response instructions 158 for the unexpected events using the unexpected event modification interface 170. Response instructions 158 may include sending an unexpected event notification 180 to the property owner, the maintenance worker, or an immediate response worker. The response instructions 158 may include saving a record of the unexpected event 146 to the memory of the server or the memory of local computing device 38*c*. The property owner may designate a portion of the unexpected events 146 as trigger events 178 (FIG. 22), which require an immediate response from the immediate response worker. The property owner may use the user inputs 182 to designate recipients for the unexpected event notifications 180 (e.g. the property owner, the maintenance worker, and/or the immediate response worker) and how the unexpected event notification 180 is sent. For example, the unexpected event notification 180 may be sent through the schedule management app 14 (FIG. 7A), as a SMS message (FIG. 7B), or as an e-mail. The property owner may also specify the content (e.g. text or an image of the unexpected event 146) that is included in the unexpected event notification 180.

Figure 7B:
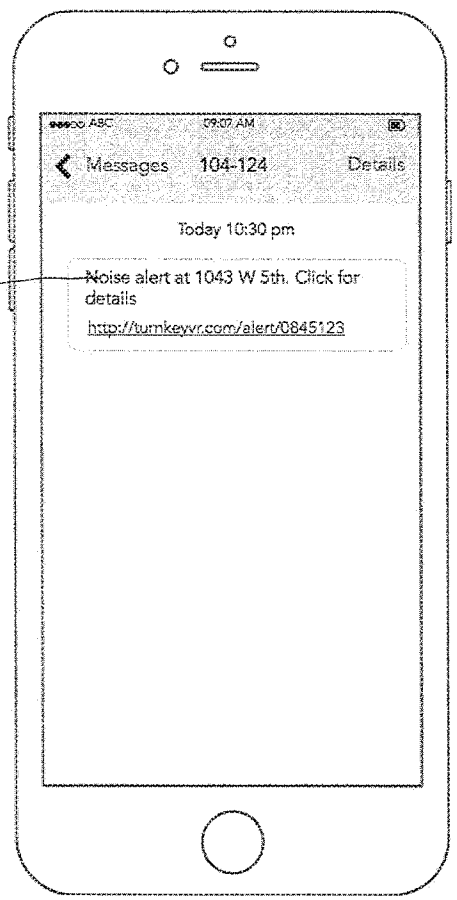
FIGS. 7A-7B illustrate unexpected event notifications sent to the property owner by the remote property management system of FIG. 1 according to some embodiments.
Figure 7A:
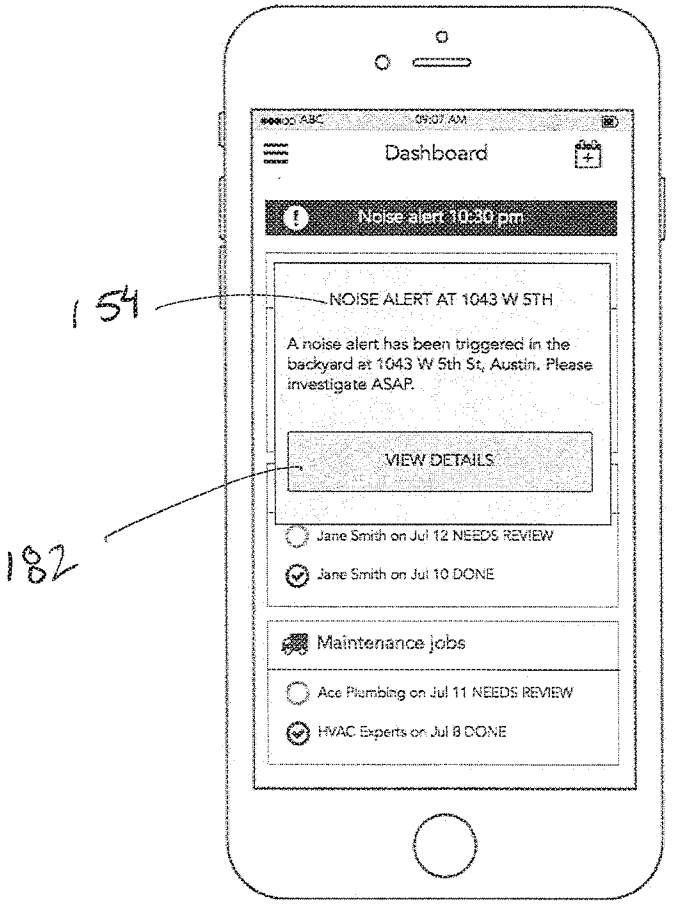

FIGS. 7A-7B show exemplary unexpected event notifications 180. The unexpected event notifications 180 alert the property owner, the maintenance worker or the immediate response worker that an unexpected event 146 has occurred. In the illustrated embodiment, the unexpected event notifications 180 include the type 154 of unexpected event 146, a location of the unexpected event 146, and a user input 182 selectable to display a detail display 186 of the unexpected event notification 180.

Figure 8B:
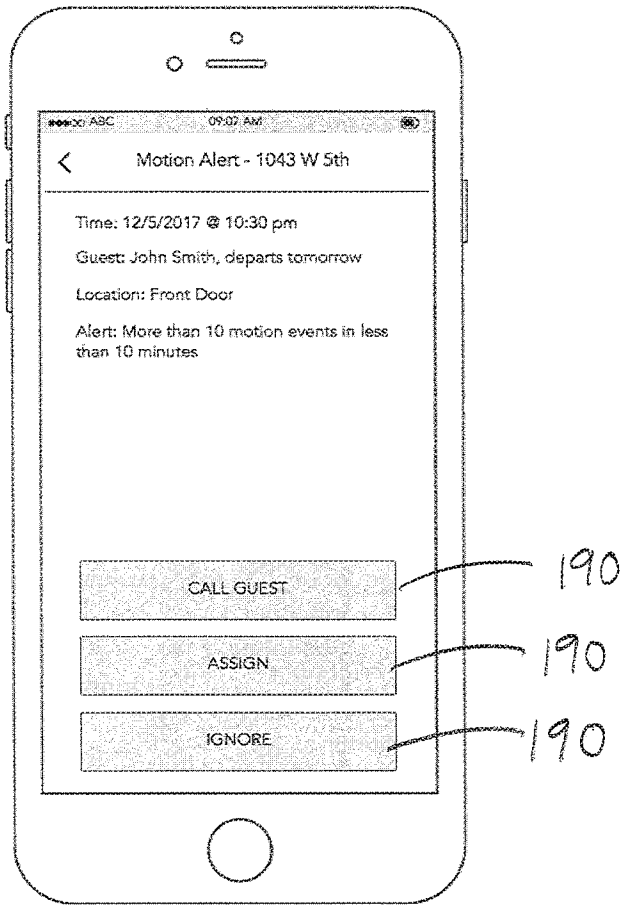
FIGS. 8A-8B illustrate detail views of the unexpected event notifications of FIGS. 7A and 7B, respectively according to some embodiments.
Figure 8A:
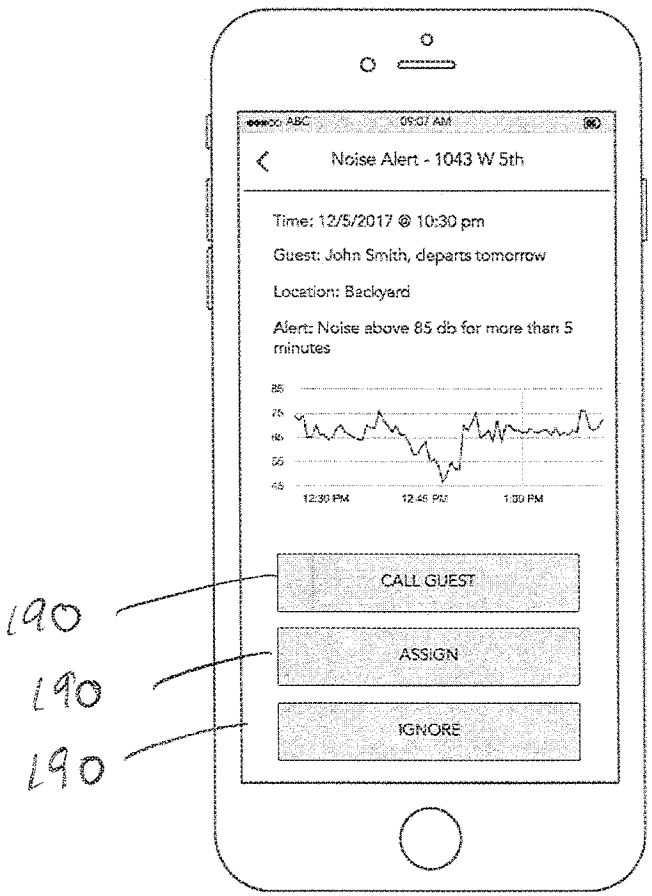

FIGS. 8A and 8B show exemplary detail displays 186 of the unexpected event notifications 180 sent to the property owner. As shown in FIGS. 8A and 8B, the detail display 186 may include a residential property status (e.g. renter name or that the residential property is unoccupied), a location of the unexpected event 146, and an type of the unexpected event 146. In some embodiments, the unexpected event notification 180 may include a graphical representation of the unexpected event 146 (FIG. 8A). In other embodiments, the unexpected event notification 180 may not include a graphical representation of the unexpected event (FIG. 8B). With continued reference to FIGS. 8A and 8B, the detail display 186 includes inputs 190 operable by the property owner to contact the renter, assign a task to a maintenance worker or an immediate response worker, or ignore the unexpected event notification 180.

Figure 9:
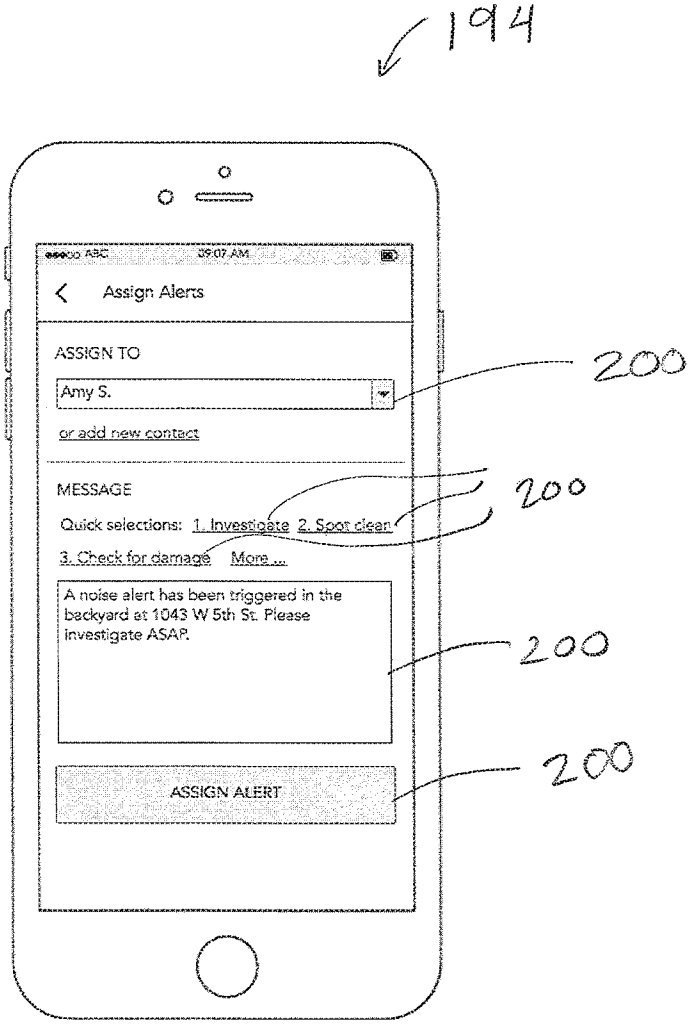
FIG. 9 illustrates an alert assignment interface of the schedule management app of the remote property management system of FIG. 1 according to some embodiments.

FIG. 9 shows an exemplary view of an assignment interface 194 of an unexpected event notification 180. In the illustrated construction, the assignment interface 194 may be displayed after the property owner selects the user input 190 for assigning a task to a maintenance worker. The property owner may use the assignment interface 194 to assign follow-up tasks 198*a*-198*n* (FIGS. 13-14) to a maintenance worker or an immediate response worker. In the illustrated embodiment, the assignment interface 194 includes user inputs 200 actuable by the property owner to assign an unexpected event notification 180 to a specified maintenance worker and to add follow-up tasks 198*a*-198*n* to the unexpected event notification 180 or the trigger notification 162. As shown in FIG. 9, the user inputs 200 may allow the property owner to select previously prepared follow-up tasks 198*a*-198*n* or enter new follow-up tasks 198*a*-198*n*.

Figure 10:
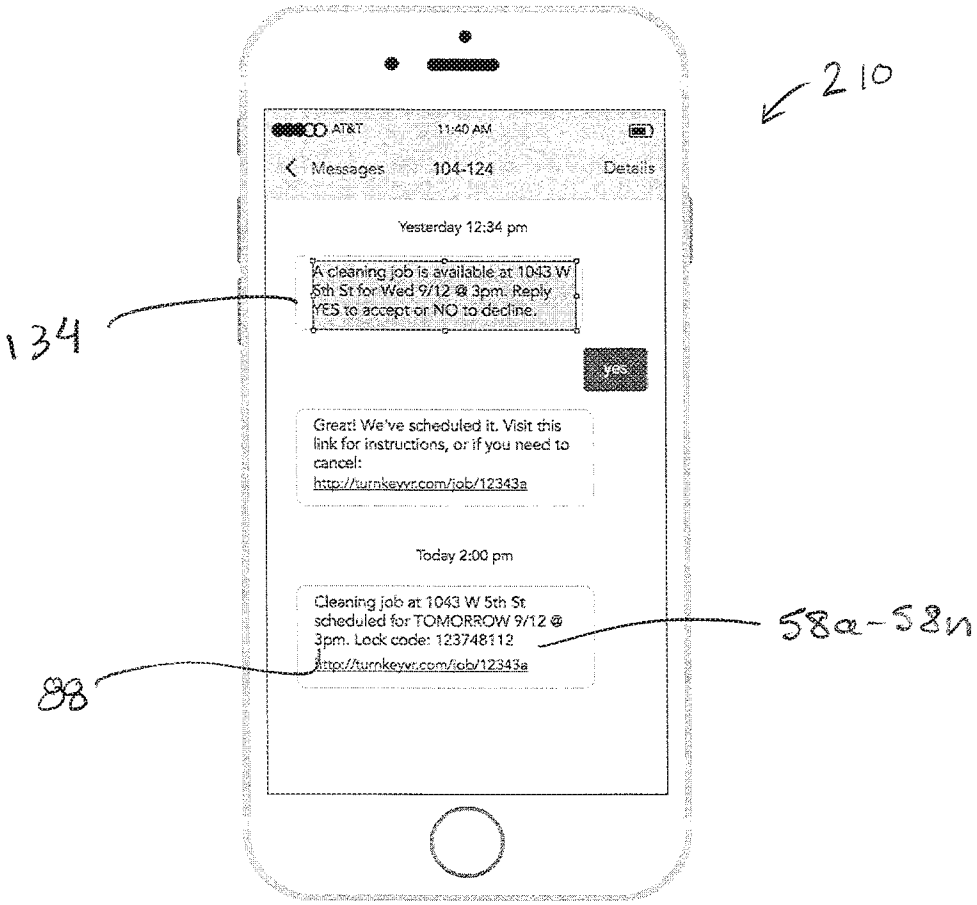
FIG. 10 illustrates a work scheduling module of a maintenance worker app of the remote property management system of FIG. 1 according to some embodiments.

Returning to FIG. 1, the maintenance worker app 18 is typically used by the maintenance worker and includes a work scheduling module 202 and a task completion module 206. The work scheduling module 202 receives scheduling notifications 210 from the schedule management app 14 and displays the scheduling notifications 210 to the maintenance worker. FIG. 10 shows an exemplary scheduling notification 210 received by the maintenance worker. As shown in FIG. 10, the scheduling notification 210 prompts the maintenance worker to accept the maintenance job 134 or decline the maintenance job 134. The term "maintenance job" is used to refer to a scheduled date and time at which at least one task list 102*a*-102*n* must be completed at the residential property. Responsive to the worker accepting the maintenance job 134, the remote property management system 10 generates the passcode 58*a*-58*n* for the electronic lock 26 of the residential property and sends the passcode 58*a*-58*n* to the maintenance worker. As described in more detail below, the passcode 58*a*-58*n* is unique to the maintenance worker, the maintenance job 134, and the passcode validity time period 88.

Figure 11:
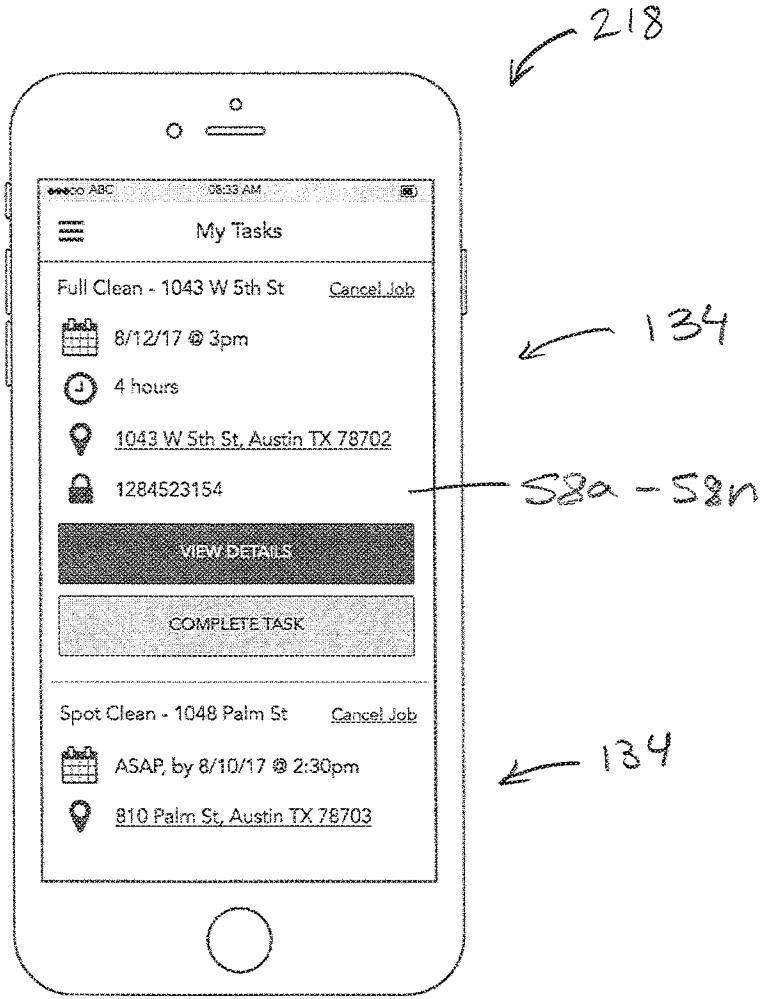
FIG. 11 illustrates a home screen of a task completion module of the maintenance worker app of the remote property management system of FIG. 1 according to some embodiments.

As shown in FIG. 11, the task completion module 206 includes a task management interface 218 that lists the maintenance jobs 134 that the maintenance worker has accepted. The task management interface 218 displays information about each maintenance job 134, including, for example, a name of the maintenance job 134, a residential property address for the maintenance job 134, a duration of the maintenance job 134, and the passcode 58*a*-58*n* for each maintenance job 134. The task management interface 218 also includes user inputs 222 actuable by the maintenance worker to maintenance worker may select a maintenance job for a specific residential property to display the task lists 102*a*-102*n* for the selected maintenance job 134.

Figure 12:
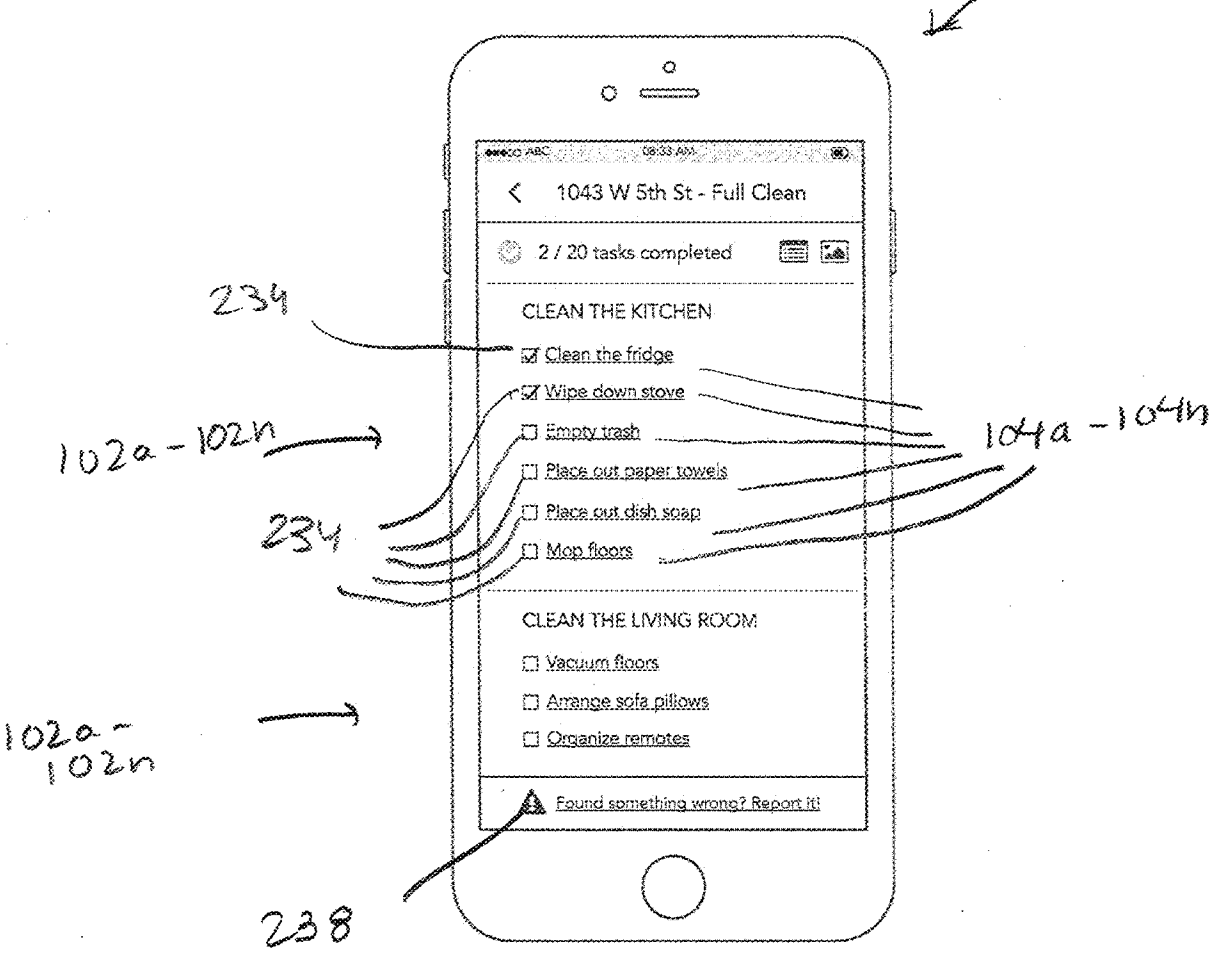
FIG. 12 illustrates task lists of the task completion module of the maintenance worker app of the remote property management system of FIG. 1 according to some embodiments.

As shown in FIG. 12, the task completion module 206 includes a task completion interface 226 that displays the task lists 102*a*-102*n* to be completed during the selected maintenance job 134. The task lists 102*a*-102*n* may include unexpected event notifications 180 that require follow up by the maintenance worker while completing the maintenance job 134. The maintenance worker may also select a completion user input 234 corresponding to each of the tasks 104*a*-104*n* to indicate completion of the selected task 104. The maintenance worker may select any of the tasks 104*a*-104*n* of the task list 102*a*-102*n* to display an image of a task area (e.g. a room or a portion of a yard) in which the task 104 is to be completed. The image of the task area may be annotated with task instructions or may include unexpected event notifications 180. As shown in FIG. 12, the task completion module 206 includes a reporting user input 238 for the maintenance worker to report any unexpected circumstances encountered at the residential property (e.g. damage to the residential property).

Figure 13:
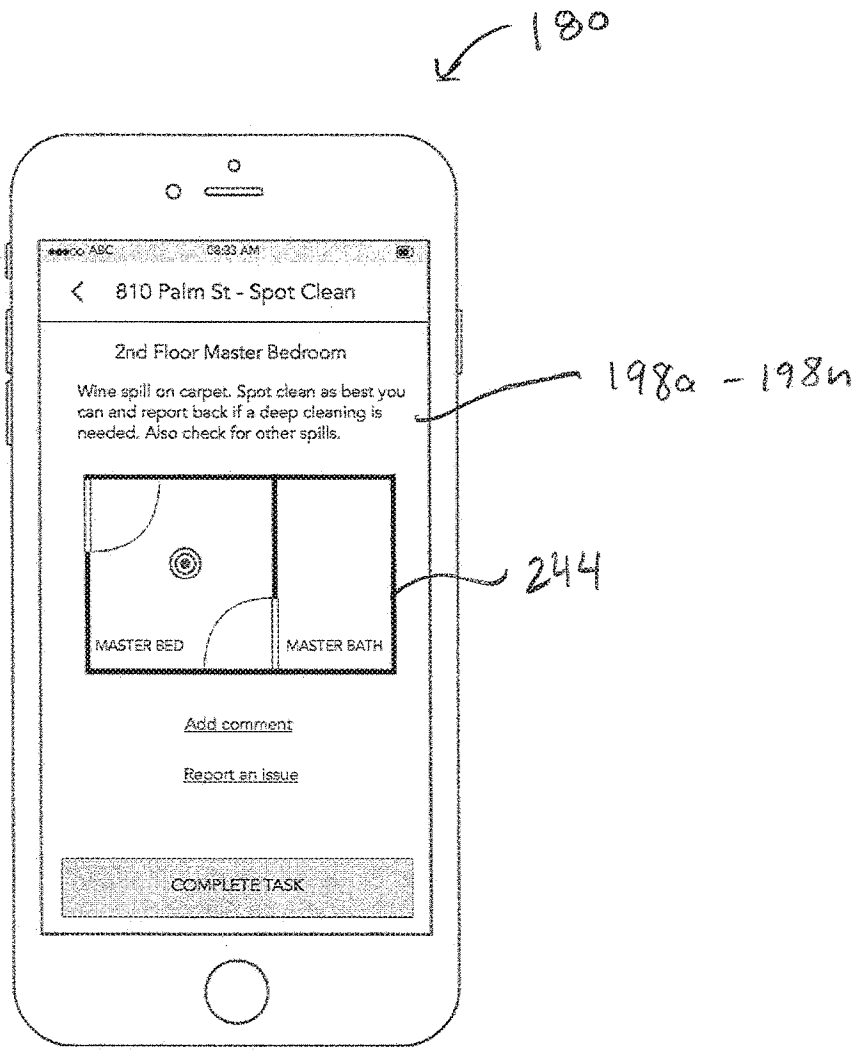
FIG. 13 illustrates an exemplary unexpected event notification of the maintenance worker app of the remote property management system of FIG. 1 according to some embodiments.
Figure 14:
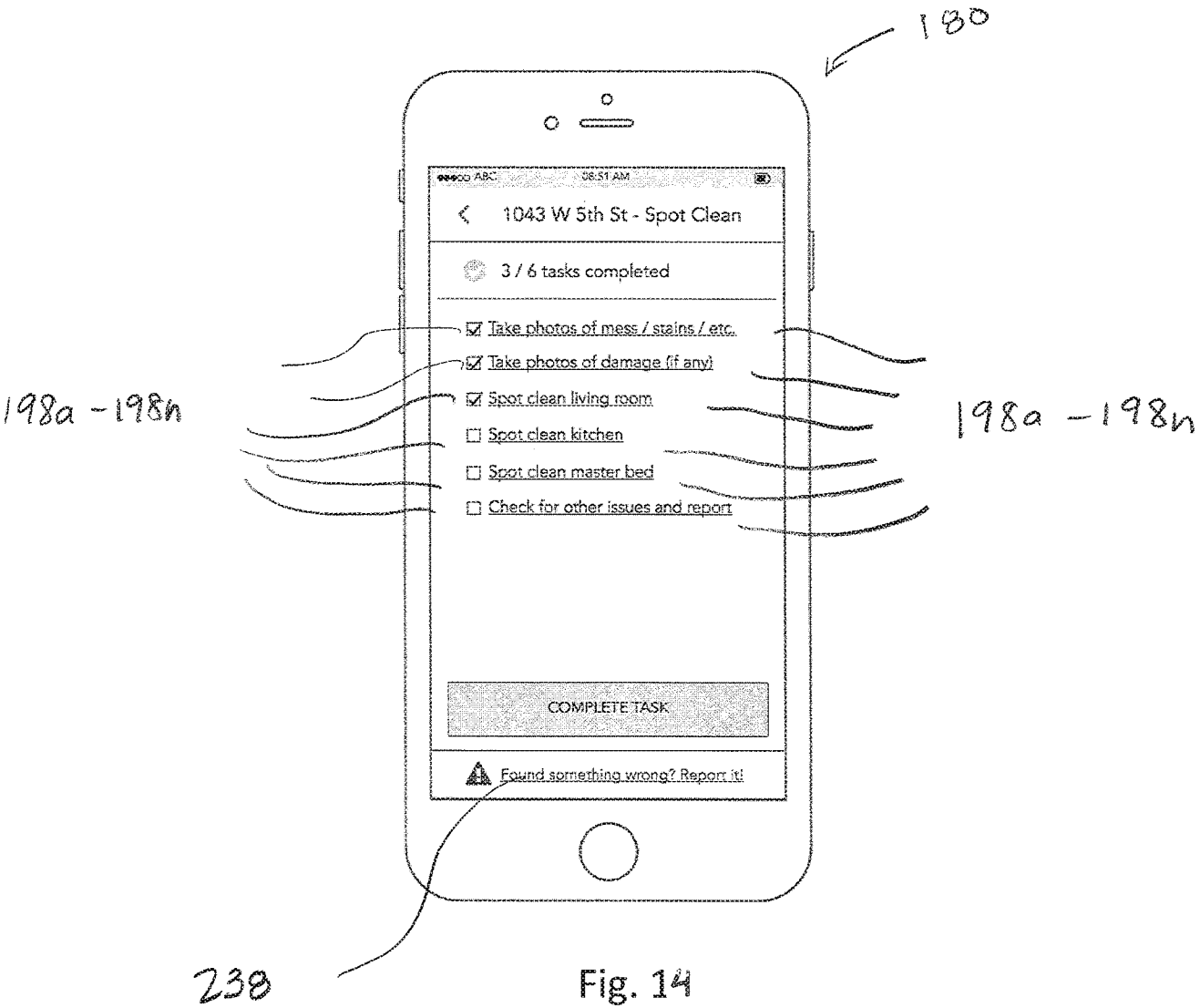
FIG. 14 illustrates an exemplary unexpected event notification of the maintenance worker app of the remote property management system of FIG. 1 according to some embodiments.

FIG. 13 and FIG. 14 show exemplary unexpected event notifications 180. The unexpected event notifications 180 alert the maintenance worker that an unexpected event 146 has previously occurred in the specified work area and displays follow-up tasks 198*a*-198*n* that must be completed in response the unexpected event 146. As shown in FIG. 13, the unexpected event notification 180 may include an image 244 annotated with a location of the unexpected event 146. As shown in FIG. 14, the task completion module 206 may require the maintenance worker to upload verification images to document completion of the assigned tasks. In some embodiments, the maintenance worker app 18 may translate written instructions to a language specified by the maintenance worker.

Figure 15:
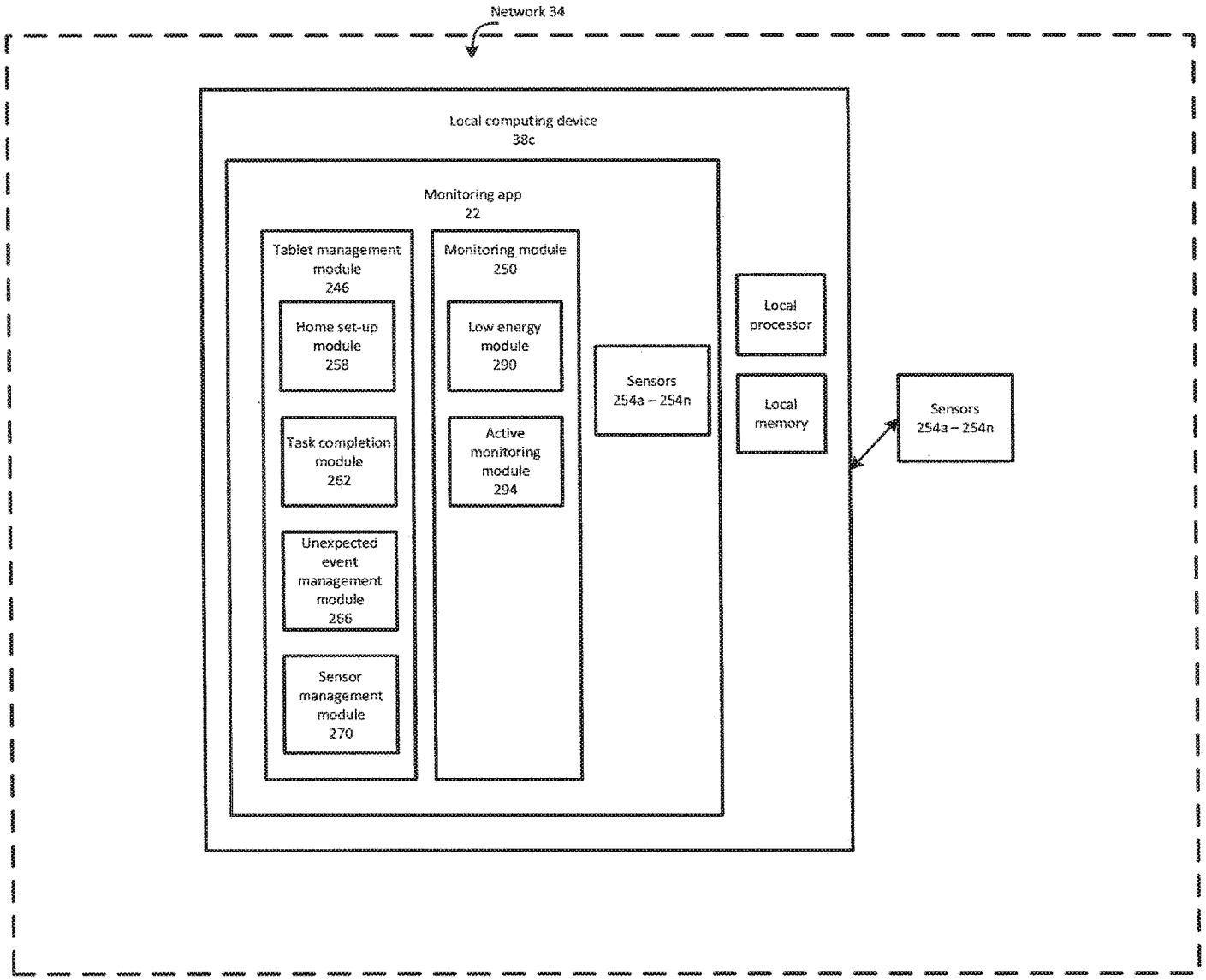
FIG. 15 illustrates a schematic representation of a monitoring app of the remote property management system of FIG. 1 according to some embodiments.

The monitoring app 22 runs on the local computing device 38*c* positioned within the residential property. As shown in FIG. 15, the monitoring app 22 includes a tablet management module 246 and a monitoring module 250. The monitoring app 22 is in electronic communication with sensors 254*a*-254*n*. The term "electronic communication" is used to generally refer to the exchange of data between at least two devices. The exchange of data may occur over wireless or wired connections between the at least two devices. The sensors 254*a*-254*n* may be positioned in different rooms of the residential property, the sensors 254*a*-254*n* may be built into the local computing device 38*c* that runs the monitoring app 22, or the sensors 254*a*-254*n* may be a combination of sensors 254*a*-254*n* positioned in different rooms of the residential property and sensors 254*a*-254*n* built-in to the local computing device 38*c* that runs the monitoring app 22. The sensors 254*a*-254*n* may include temperature sensors, audio sensors, motion sensors, light sensors, or other types of sensors suitable for monitoring a residential property.

Figure 16:
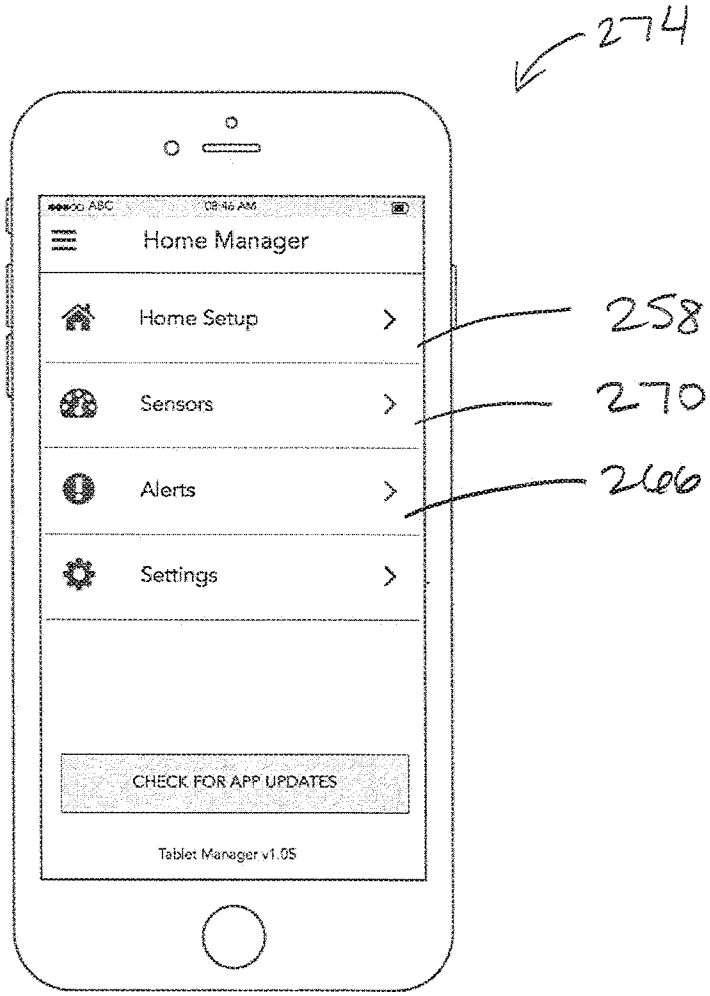
FIG. 16 illustrates an interface of the monitoring app of the remote property management system of FIG. 1 according to some embodiments.

With continued reference to FIG. 15, the tablet management module 246 includes a home setup module 258, a task completion module 262, an unexpected event management module 266, and a sensor management module 270. The tablet management module 246 includes a tablet management interface 274 (FIG. 16). The tablet management module 246 may have a locked state in which a tablet management interface 274 is not displayed and an unlocked state in which the tablet management interface 274 is displayed. In such an embodiment, the tablet management module 246 may require authentication (e.g. input of a correct password or biometric input) by the property owner, the maintenance worker, or the immediate response worker before displaying the tablet management interface 274. FIG. 16 illustrates the tablet management interface 274 displayed to the property owner. The property owner may use the tablet management interface 274 to select to display the home setup module 258, the sensor management module 270, and the unexpected event management module 266. The tablet management interface 274 displayed to a maintenance worker may include access to the task completion module 262.

The home setup module 258 is substantially the same as the task setup module 70 of the schedule management app 14. The property owner may use home setup module 258 of the monitoring app 22 as described above for the task setup module 70 of the schedule management app 14. The property owner may use the unexpected event management module 266 to designate unexpected events 146 and the follow-up tasks 198*a*-198*n* as described above for the schedule management app 14. The task completion module 262 is substantially the same as the task completion module 206 of the maintenance worker app 18.

Figure 17:
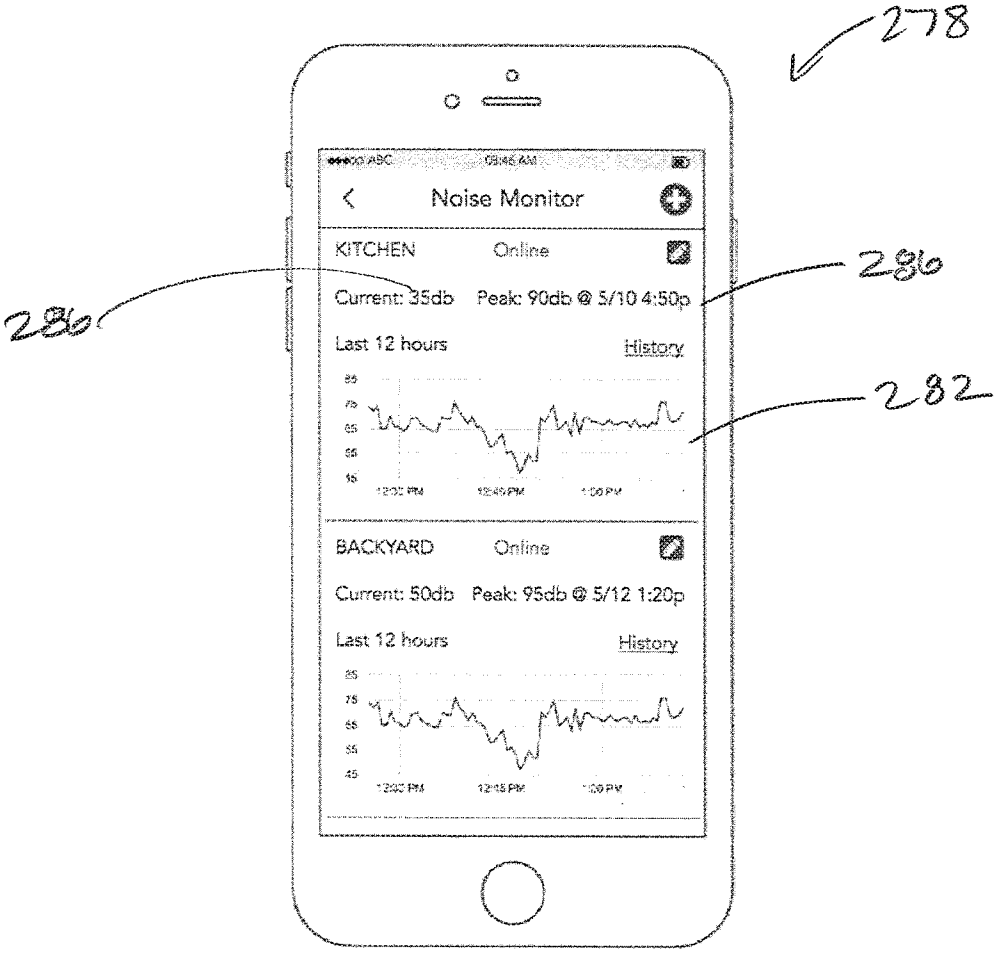
FIG. 17 illustrates a monitoring interface of the monitoring app of the remote property management system of FIG. 1 according to some embodiments.

The property owner may use the sensor management module 270 to configure the sensors 254*a*-254*n* of the remote property management system 10. The sensor management module 270 may include a sensor management interface 278 configured to allow the property owner to establish wireless communication between the sensors 254*a*-254*n* and the local computing device 38*c*. The property owner may also use the sensor management module 270 to configure the threshold settings of the sensors 254*a*-254*n* that correspond to unexpected events 146. In some constructions, the sensor management module 270 may display data sensed by the sensors 254*a*-254*n*. As shown in FIG. 17, the sensor management module 270 be accessed through the schedule management app 14 to display the data sensed by the sensors 254*a*-254*n* in the sensor management interface 278. As shown in FIG. 17, the data sensed by the sensors may be displayed graphically 282 or displayed using text 286. The sensed data displayed on the sensor management interface 278 may be displayed in real-time, substantially real-time, or may include all of the data sensed for a specified time period. In some embodiments, the specified time period may be minutes, hours, days, weeks, or months. More particularly, in some embodiments, the specified time period is 12 hours.

The monitoring app 22 runs the monitoring module 250 continuously in the background when the monitoring app 22 is not in the home setup module 258. In some embodiments, the monitoring app 22 has a low energy module 290 (FIG. 15) and an active monitoring module 294 (FIG. 15). While the monitoring app 22 is in the low energy module 290, the active monitoring module 294 may be triggered in response to detection of the unexpected event 146, a known reservation time, or a scheduled maintenance job 134. In other embodiments, the monitoring app 22 is always in the active monitoring module 294.

Figure 18:
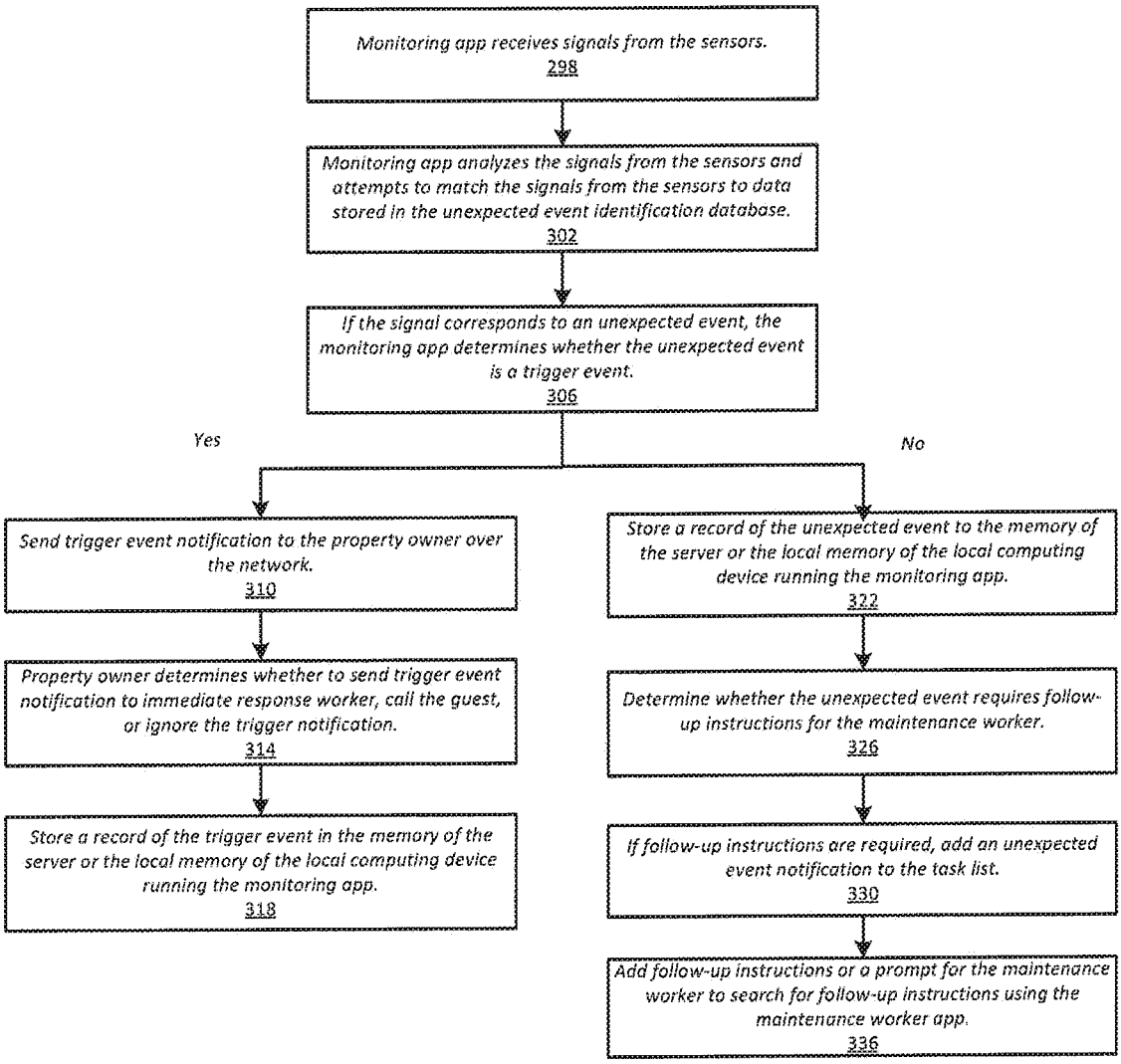
FIG. 18 illustrates a flow diagram of the monitoring module of the monitoring app of the remote property management system of FIG. 1 according to some embodiments.

As shown in FIG. 18, in the monitoring module 250, the monitoring app 22 receives signals from the sensors 254*a*-254*n* (block 298). The monitoring app 22 analyzes the signals from the sensors 254*a*-254*n* and attempts to match the signals from the sensors 254*a*-254*n* to data stored in the unexpected event identification database 50 (block 302). When the monitoring app 22 detects a match between the one of the signals sent by one of the sensors 254*a*-254*n* and a signal profile of one of the unexpected events 146, the monitoring app 22 determines whether the unexpected event 146 is the trigger event 178 (block 306). In some embodiments, if the unexpected event 146 is the trigger event 178, the monitoring app 22 sends the trigger notification 162 to the property owner (block 310). As described above, in response to receiving the trigger notification 162, the property owner may call the renter, send the trigger notification 162 to the immediate response maintenance worker over the network 34, or ignore the trigger notification (block 314). In other embodiments, the trigger notification 162 is sent to the immediate response worker over the network 34 without requiring action by the property owner. The monitoring app 22 may also save a type of the trigger event 178, a location of the trigger event 178, a time of occurrence of the trigger event 178 to the either the memory 46 of the server 30 or the memory of the local computing device 38*c* running the monitoring app 22 (block 318).

Figure 19:
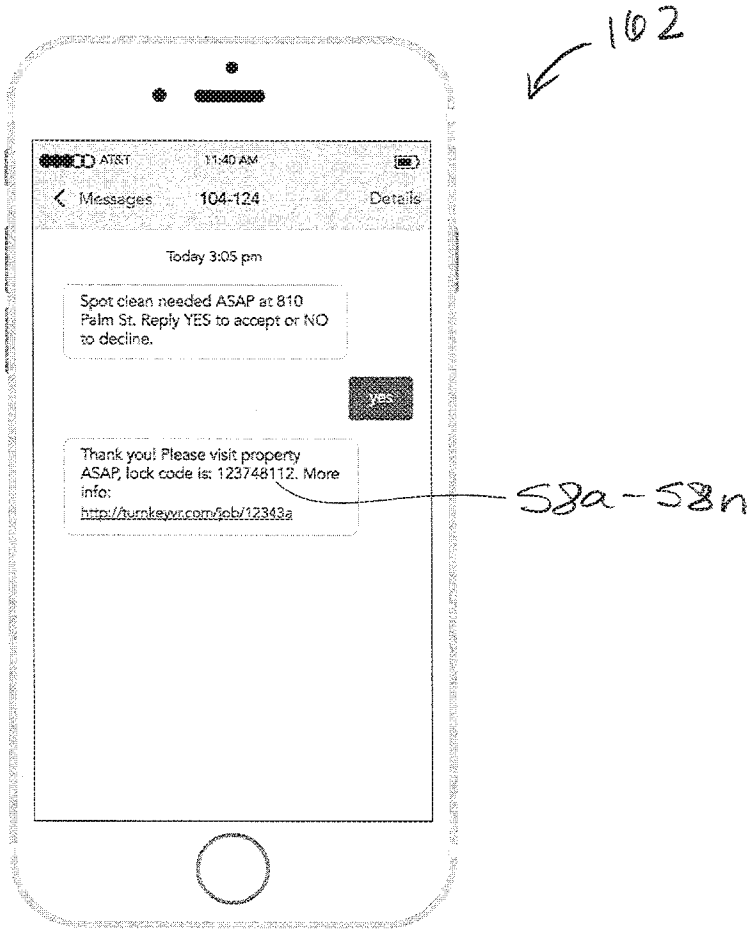
FIG. 19 illustrates a trigger event notification of the maintenance worker app of the remote property management system of FIG. 1 according to some embodiments.

As shown in FIG. 19, the trigger notification 162 sent to the immediate response worker may include the type of the trigger event 178 type, the location of the trigger event 178, the time of occurrence of the trigger event 178, and the passcode 58*a*-58*n* to the electronic lock 26 of the residential property. The trigger notification 162 may also prompt the immediate response worker to acknowledge receipt of the trigger notification 162 or to accept the trigger notification 162. The term "trigger event type" is generally used to refer to a sensor output indicative of the trigger event 178. Exemplary trigger event types 178 may include audio, temperature, motion, and light. The passcode 58*a*-58*n* is unique to the immediate response worker, the trigger event 178, and the passcode validity time period 88. As shown in FIGS. 7A-8B trigger notification 162 sent to the property owner may include at least one of the type of the trigger event 178, the location of the trigger event 178, the time of occurrence of the trigger event 178, and the type of immediate response worker sent to respond the trigger event 178.

Returning to FIG. 18, responsive to determining that the unexpected event 146 is not the trigger event 178, the monitoring app 22 may store a type of the unexpected event 146, a location of the unexpected event 146, and a time of occurrence of the unexpected event 146 to the memory 46 of the server or the memory of the local computing device 38*c* running the monitoring app 22 (block 322). The monitoring app 22 also queries the memory 46 of the server or the memory of the local computing device 38*c* running the monitoring app 22 to determine whether the unexpected event 146 requires follow-up tasks for the maintenance worker (block 326). If the unexpected event 146 does require follow-up tasks 198*a*-198*n* for the maintenance worker, the monitoring app 22 accesses the task list 102*a*-102*n* corresponding to the location of the unexpected event 146 and adds an unexpected event notification 180 corresponding to the unexpected event 146 to the task list 102*a*-102*n* (block 330, FIGS. 13-14). The unexpected event notification 180 may include follow-up tasks 242*a*-242*n* related to the unexpected event 146, or the unexpected event notification 180 may prompt the maintenance worker to search for follow-up tasks 198*a*-198*n* using an interface of the maintenance worker app 18 (block 334, FIGS. 13-14).

Controlling Access

Figure 20:
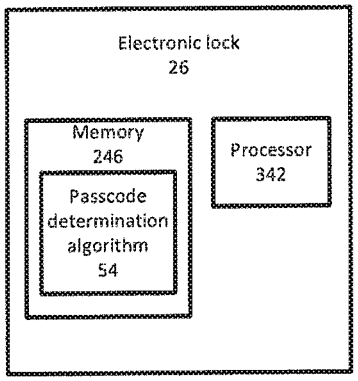
FIG. 20 illustrates an electronic lock for use with the remote property management system of FIG. 1 according to some embodiments.

The electronic lock 26 is engaged with at least one entry point of the residential property and controls access to the residential property by requiring entry of the passcode 58*a*-58*n* to access the entry point. As shown in FIGS. 1 and 20, the electronic lock 26 is isolated from the network and includes a processor 338 and a memory 342. The memory 342 includes instructions for the passcode determination algorithm 54 executable by the processor 338. The passcode determination algorithm 54 is a hash algorithm adapted to return the passcodes 58*a*-58*n* for the electronic lock 26. The memory 46 of the server 30 and/or the memory of the local computing device 38*a* running the schedule management app 14 also includes instructions for the passcode determination algorithm 54 executable by the processor 42 of the server 30 or the processor of the local computing device 38*a* running the schedule management app 14. Accordingly, even though the electronic lock 26 is isolated from the network 34, the schedule management app 14 can determine a valid passcode 58*a*-58*n* for the electronic lock 26 at a passcode validity time period 88. The passcodes 58*a*-58*n* generated by the passcode determination algorithm 54 may be generated in advance of the passcode validity time period 88.

Figure 21:
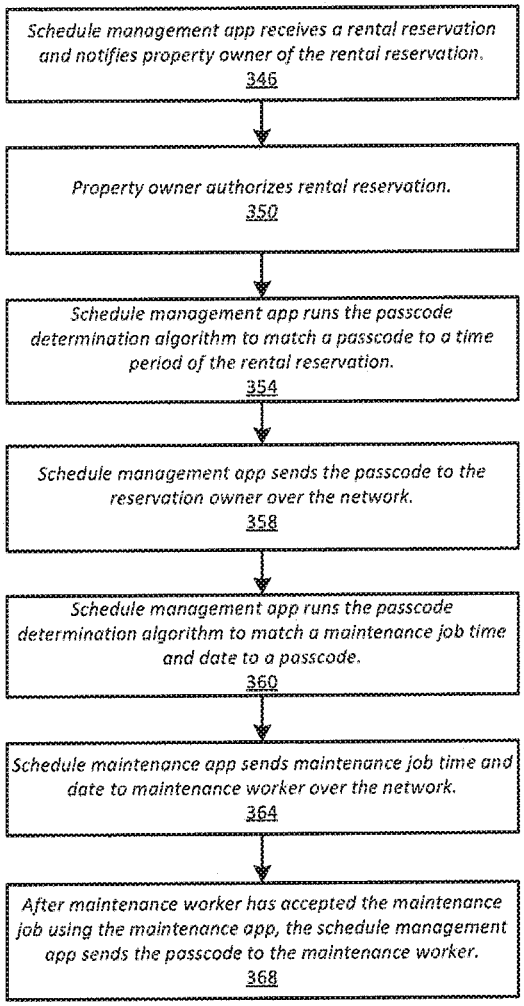
FIG. 21 illustrates a flow diagram of the passcode generation algorithm of an electronic lock of the remote property management system of FIG. 1 according to some embodiments.

As shown in FIG. 21, responsive to receiving the rental reservation, the schedule management app 14 notifies the property owner of the rental reservation (block 346). After the property owner authorizes the rental reservation (block 350), the schedule management app 14 queries the passcode determination algorithm 54 to match a time period (a start date and a start time to an end date and an end time) of the rental reservation to the passcode 58*a*-58*n* of the electronic lock 26 (block 354). Responsive to identifying a match between the time period of the rental reservation and the passcode 58*a*-58*n* for the electronic lock 26, the schedule management app 14 sends the passcode 58*a*-58*n* for the electronic lock 26 to the renter over the network 34 (block 358). After the property owner authorizes the rental reservation, the schedule management app 14 queries the passcode determination algorithm 54 to match a maintenance date and time to the passcode 58*a*-58*n* (block 362). The schedule management app 14 then sends the maintenance job 134, including the maintenance job 134 time and date to the maintenance worker over the network 34 (block 366). Responsive to the maintenance worker accepting the maintenance job 134, the remote property management system 10 sends the passcode 58*a*-58*n* to the maintenance worker (block 370).

In the illustrated embodiment, the maintenance job 134 is scheduled one or two days before the rental reservation. In other embodiments, the maintenance job 134 is scheduled a different number of days before the rental reservation. In some embodiments, the schedule management app 14 schedules the maintenance job 134. In other embodiments, the maintenance worker schedules the maintenance job 134 when the maintenance worker accepts the maintenance request. In such an embodiment, upon receiving the maintenance job 134 date and time period from the maintenance worker, the schedule management app 14 queries the passcode determination algorithm 54 in the memory 46 to determine the passcode 58*a*-58*n* for the electronic lock 26 to match the date and time of the maintenance job 134 selected by the maintenance worker. In some embodiments, the schedule management app 14 may not require the property owner to accept the reservation before generating the passcode 58*a*-58*n* for the renter or to schedule the maintenance job 134 and generate the passcode 58*a*-58*n* in response to receiving the rental reservation.

The schedule management app 14 is also operable to schedule recurrent maintenance jobs. The term "recurrent maintenance job" is generally used to refer to a maintenance job that occurs regularly as part of a schedule, as opposed to the maintenance job 134 scheduled in response to the reservation or scheduled in response to the trigger event 178. For example, the schedule management app 14 may be used to schedule recurrent cleaning or lawn maintenance jobs. Responsive to the maintenance worker accepting the recurrent maintenance job, the schedule management app 14 queries the passcode determination algorithm 54 to match a time and date of the recurrent maintenance job with the passcode 58*a*-58*n* for the electronic lock 26 for each instance of the recurrent maintenance job.

The schedule management app 14 is also operable to schedule one-time maintenance jobs. The term "one-time maintenance job" is generally used to refer to a maintenance job that is not the recurrent maintenance job and that is not scheduled in response to the reservation for the residential property. For example, a visit from a plumber or a visit from an immediate response maintenance worker in response to the trigger event 178 are one-time maintenance jobs. Responsive to a maintenance worker accepting the one-time maintenance job, the schedule management app 14 queries the passcode determination algorithm 54 to match the time and the date of the one-time maintenance job with the passcode 58*a*-58*n* for the electronic lock 26.

Unexpected Events

As shown in FIG. 22, the property owner may access the unexpected event identification database 50 stored on the memory 46 of the server 30 to select a plurality of sensor outputs 374*a*-374*n* indicative of anomalous events 378*a*-378*n* to monitor. The schedule management app 14 stores the selected anomalous events 378*a*-378*n* as unexpected events 146. The unexpected events 146 may either be saved on the memory 46 of the server or the memory of the local computing device 38*c* that runs the monitoring app 22. The property owner may designate a portion of the unexpected events 146 as trigger events 178, which require an immediate response from the immediate response worker.

The unexpected event identification database 50 is a database of the sensor outputs 374*a*-374*n* indicative of the anomalous events 378*a*-378*n*. For example, the unexpected event identification database 50 may include the sensor outputs 374*a*-374*n* indicative of acoustic anomalies, the sensor outputs 374*a*-374*n* indicative of motion anomalies, the sensor outputs 374*a*-374*n* indicative of light anomalies, and the sensor outputs 374*a*-374*n* indicative of temperature anomalies. Some of the sensor outputs 374*a*-374*n* correspond to the sensor outputs 374*a*-374*n* that are only considered anomalous events 378*a*-378*n* when the residential property is unoccupied. In some cases, the sensor output 374*a*-374*n* may correspond to the anomalous events 378*a*-378*n* if the residential property is occupied or unoccupied.

Acoustic anomalies are sound profiles corresponding to known unexpected events 146. Some events are always unexpected events, such as a sound of breaking glass, an acoustic profile indicative of fluid (e.g. water, natural gas, heating oil) leaking from a pipe, an alarm such as a smoke detector or a CO detector, or cycling of motor of a sump pump. Some acoustic anomalies are only considered unexpected events 146 when the residential property is known to be unoccupied. For example, human voices, music, or vehicle noise that occurs at a time when the residential property is scheduled to be unoccupied may be considered to be unexpected events. The sensor outputs 374*a*-374*n* indicative of acoustic anomalies may include acoustic profiles 382 that correspond to specific event identities. If either the unexpected event 146 or the trigger event 178 is an audio event, the remote property management app 10 may include a name of the event identity in the unexpected event notification 180 or the trigger notification 162.

Motion anomalies are motions that occur when at a time when the residential property is scheduled to be empty. Light anomalies are anomalies that occur at time when the residential property is scheduled to be empty. Light anomalies may be the presence of unexpected light (e.g. an intruder using a flashlight) or the absence of expected light (e.g. a light scheduled to operate on a timer has stopped operating). Temperature anomalies may include indoor temperatures that are above a predetermined temperature range or indoor temperatures that are below the predetermined temperature range.

Various features and advantages of the disclosure are set forth in the following claims.

What is claimed is:

1. A computer implemented method comprising:

recognizing, by a first computing system including an acoustic sensor, a sound indicative of an unexpected event in a property;

retrieving, by the first computing system, an acoustic profile of the unexpected event from a database; and responsive to retrieving the acoustic profile of the unexpected event, transmitting, by the first computing system, a notification including an identity of the acoustic profile of the unexpected event to a second computing system over a network, the notification including a passcode for a lock that controls access to the property.

2. The method of claim 1, further comprising:

receiving, by the first computing system, a confirmation of a response to the unexpected event, wherein transmitting the notification includes transmitting the identity of the acoustic profile of the unexpected event and transmitting, after transmitting the identity of the acoustic profile of the unexpected event, the passcode for the lock based on the confirmation of a response to the unexpected event.

3. The method of claim 1, wherein the notification includes a location of the unexpected event in the property.

4. The method of claim 1, wherein the notification includes instructions for responding to the unexpected event.

5. The method of claim 1, wherein the passcode for the lock is associated with a passcode validity time period during which the passcode is valid to open the lock.

6. The method of claim 1, further comprising:

storing a record of the notification in a memory of the first computing system;

notifying a user to access the record of the notification; and displaying the stored record of the notification on an interface of the first computing system.

7. A computer implemented method comprising:

detecting, based on an output of a sensor, an unexpected event in a property;

responsive to detecting the unexpected event, retrieving a type of the unexpected event from a database;

retrieving, based on the type of the unexpected event, a unique passcode for a lock that controls access to the property; and transmitting a notification of the type of the unexpected event and the unique passcode for the lock to a user.

8. The method of claim 7, further comprising generating the unique passcode using a hash algorithm for an electronic lock.

9. The method of claim 7, further comprising receiving a confirmation of a response to the unexpected event by the user, wherein transmitting the notification of the type of the unexpected event and the unique passcode includes transmitting the type of the unexpected event and, responsive to receiving the confirmation of a response to the unexpected event, transmitting the unique passcode after transmitting the type of the unexpected event.

10. The method of claim 7, wherein the output of the sensor is indicative of one of acoustic, motion, light and temperature anomalies and the type of the unexpected event is one of sound, motion, light and temperature.

11. The method of claim 7, wherein the notification includes a location of the unexpected event in the property.

12. The method of claim 7, wherein the notification includes instructions for responding to the unexpected event.

13. The method of claim 7, wherein the unique passcode for the lock is associated with a unique passcode validity time period during which the unique passcode is valid to open the lock.

14. The method of claim 7, further comprising:

storing a record of the notification; and notifying a user to access the stored record of the notification.

* * * * *